US007847771B2

(12) United States Patent
Maruyama et al.

(10) Patent No.: US 7,847,771 B2
(45) Date of Patent: Dec. 7, 2010

(54) DISPLAY DEVICE CAPABLE OF ADJUSTING DIVIDED DATA IN ONE FRAME

(75) Inventors: Junichi Maruyama, Yokohama (JP); Hiroyuki Nitta, Fujisawa (JP); Yoshihisa Ooishi, Yokohama (JP); Kikuo Ono, Mobara (JP)

(73) Assignee: Hitachi Displays, Ltd., Chiba (JP)

( * ) Notice: Subject to any disclaimer, the term of this patent is extended or adjusted under 35 U.S.C. 154(b) by 932 days.

(21) Appl. No.: 11/279,598

(22) Filed: Apr. 13, 2006

(65) Prior Publication Data

US 2006/0256141 A1 Nov. 16, 2006

(30) Foreign Application Priority Data

May 11, 2005 (JP) ..... 2005-137986
Aug. 8, 2005 (JP) ..... 2005-229008

(51) Int. Cl.
*G09G 3/36* (2006.01)

(52) U.S. Cl. ..... 345/89; 345/690

(58) Field of Classification Search ..... 345/63, 345/77, 89, 208, 690, 87
See application file for complete search history.

(56) References Cited

U.S. PATENT DOCUMENTS 5,347,294 A 9/1994 Usui et al.
5,528,257 A * 6/1996 Okumura et al. ..... 345/99
7,084,846 B2 * 8/2006 Adachi et al. ..... 345/89
7,348,951 B2 * 3/2008 Aoki ..... 345/87
2002/0030670 A1 3/2002 Matsueda
2002/0060662 A1 * 5/2002 Hong ..... 345/102
2003/0011614 A1 * 1/2003 Itoh et al. ..... 345/589
2004/0001054 A1 1/2004 Nitta et al.
2004/0141094 A1 7/2004 Kumamoto et al.
2004/0155847 A1 * 8/2004 Taoka et al. ..... 345/87
2006/0119617 A1 * 6/2006 Toyooka et al. ..... 345/619

FOREIGN PATENT DOCUMENTS

JP 4-365094 A 12/1992
JP 2002-82657 A 3/2002

(Continued)

OTHER PUBLICATIONS

International Search Report and Written Opinion of the International Searching Authority, Issued in International Application No. PCT/JP2006/309770, dated on Aug. 30, 2006.

*Primary Examiner*—Chanh Nguyen
*Assistant Examiner*—Kwang-Su Yang
(74) *Attorney, Agent, or Firm*—McDermott Will & Emery LLP

(57) ABSTRACT

A speed doubling circuit receiving display data in one frame period and outputting field A display data and field B display data in one frame period. A field conversion circuit converts the field A display data to have a highest gray-scale if the display data has a high gray-scale, and converts the field B display data to have a lowest gray-scale if the display data has a low gray-scale. Between the speed doubling circuit and field conversion circuit, an emphasis circuit is disposed which emphasizes each of the field A display data and field B display data in accordance with the display data one frame period before and the display data in the present frame period.

13 Claims, 9 Drawing Sheets

FOREIGN PATENT DOCUMENTS

| | | | |
|---|---|---|---|
| JP | 2003-167555 | A | 6/2003 |
| JP | 2003-280599 | A | 10/2003 |
| JP | 2004-240317 | A | 8/2004 |
| JP | 2004-304390 | A | 10/2004 |
| JP | 2005-141190 | A | 6/2005 |
| WO | WO 00/25291 | | 5/2000 |

* cited by examiner

DISPLAY DEVICE CAPABLE OF ADJUSTING DIVIDED DATA IN ONE FRAME

INCORPORATION BY REFERENCE

The present application claims priority from Japanese applications JP 2005-137986 filed on May 11, 2005, and JP 2005-229008 filed on Aug. 8, 2005, the contents of which are hereby incorporated by reference into this application.

BACKGROUND OF THE INVENTION

The present invention relates to a hold-type display device such as a liquid crystal display device, an organic electro luminance (EL) display and a liquid crystal on silicon (LCOS) display and its driving method, and more particularly to a display device suitable for displaying moving images and its driving method.

Display devices are mainly classified into an impulse type display device and a hold-type display device if the display devices are classified from the viewpoint of moving image display. The impulse type display device is a device like a Brown tube of the type that pixels become bright only during a scanned period and a luminance of each pixel lowers immediately after scanning, whereas the hold-type display device is a device like a liquid crystal display device of the type that the brightness corresponding to display data continues to be held until next scanning.

The characteristics of a hold-type display device reside in that although a good display quality can be obtained for still images, a peripheral area of a moving image blurs, i.e., so-called moving image blurring occurs, and a display quality is lowered. This moving image blurring results from a so-called retina after image by which when a line of sight follows a moving image, the viewer interpolates display images after and before motion into a display image having a luminance of a hold-type. Therefore, even if a response speed of the display device is improved as fast as possible, the moving image blurring cannot be eliminated completely.

As a technique of eliminating moving image blurring of a hold-type display device, U.S. Patent Publication No. 2004/001054 (JP-A-2003-280599) discloses the technique of inserting blanking data (black display data) between consecutive display data (hereinafter abbreviated a black display data insertion method), namely, displaying display data and blanking data in one frame period.

As a technique of inserting black display data, U.S. Patent Publication No. 2004/155847 (JP-A-2004-240317) discloses the following technique. When a desired pixel value is to be written in a pixel of a hold-type display device, an effective write operation is concentrated on a partial period of a frame period. In this case, in order to obtain a desired visual pixel value from the write operation during the partial period, a write value during the partial period is set higher than the desired pixel value, so that write values of pixels during a period other than the partial period become relatively low to thereby obtain visual recognition of a moving image similar to that of an impulse type display device. According to this technique, a frame period is divided into m periods (m is an integer of 2 or larger). By representing m periods as first to m-th periods, a desired pixel value multiplied by m is written in pixels during the first period, and 0 is written during the second to following periods. In this display device, if the pixel value multiplied by m exceeds an allowable display range of the display device, an upper limit value of the range is written in the first period, and an excessive portion not written in the first period is written in pixels during the second period.

Similarly, an excessive portion not written during the i-th period ($2 \leqq i \leqq m-1$) is sequentially written in pixels during the (i+1)-th period to improve visual recognition of moving images. In this specification, this drive method is defined as frame division drive.

In a liquid crystal display device, moving image blurring occurs also due to a slow response time of liquid crystal elements. In order to solve this liquid crystal response speed problem, U.S. Pat. No. 5,347,294 (JP-A-4-365094) discloses the following drive method. A drive voltage to be supplied to the liquid crystal display panel is changed with a difference between an input image signal one frame before and an input image signal of a present frame. Namely, if a gray-scale of the input image signal of the present frame is higher than a gray-scale of the input image signal one frame before, i.e., if an image of the present frame is brighter than that one frame before, a drive voltage higher than a gray-scale voltage of the input image signal of the present frame is applied to the liquid crystal display panel. On the other hand, if a gray-scale of the input image signal of the present frame is lower than a gray-scale of the input image signal one frame before, i.e., if an image of the present frame is darker than that one frame before, a drive voltage lower than a gray-scale voltage of the input image signal of the present frame is applied to the liquid crystal display panel. In this specification, this drive method is defined as emphasis drive.

SUMMARY OF THE INVENTION

In this specification, each m-divided frame in the frame division drive is defined as a field. When a desired gray-scale on the high gray-scale side is to be displayed in the frame division drive, a desired gray-scale corresponding to an input image signal is displayed by combining the highest gray-scale field and lower gray-scale fields. In this case, the emphasis drive cannot be applied to the highest gray-scale field, because emphasis in excess of the highest gray-scale is impossible. In displaying a desired gray-scale on the low gray-scale side, a desired gray-scale corresponding to an input image signal is displayed by combining the lowest gray-scale field and higher gray-scale fields. In this case, the emphasis drive cannot be applied to the lowest gray-scale field, because emphasis lower than the lowest gray-scale is impossible. As described above, it is difficult to apply the emphasis drive simply to the frame division drive.

An object of the present invention is to provide a display device for displaying a plurality of display data in one frame period, the display device being capable of reducing moving image blurring and improving a moving image quality, by reducing a delay in a pixel response speed and an insufficient luminance to be caused by shortening a write period of a display signal.

According to the present invention, there are provided: a first conversion circuit, e.g., a speed doubling circuit and an emphasis circuit, for receiving the display data in one frame period, emphasizing the display data in an n-th (n being an integer of 1 or larger) frame period in accordance with a value of the display data in an (n−1)-th frame period and a value of the display data in the n-th frame period, and outputting emphasized m (m being an integer of 2 or larger) display data in each of m periods in one frame period; and a second conversion circuit, e.g., a field conversion circuit, for converting each of the emphasized m display data in such a manner that each pixel provides a luminance corresponding to the display data input during one frame period by using the m display data.

In the display data realizing a luminance corresponding to the input display data in one frame period by displaying display data in one frame period time divisionally, if at least one of the m display data has an upper limit value of a dynamic range of the display data and the input display data changes between frames, a value of at least another one of the m display data is changed.

According to the present invention, in the display device for displaying a plurality of display data in one frame period, it is possible to reduce moving image blurring and improve a moving image quality, by reducing a delay in a pixel response speed and an insufficient luminance to be caused by shortening a write period of a display signal. In other words, by applying the frame division drive to a hold-type display device, it becomes possible to realize the optical emission characteristics of an impulse type display device and obtain a good display quality with less moving image blurring. By using the emphasis drive, it becomes possible to shorten a time required for an apparent luminance response and obtain a good display quality with less moving image blurring.

According to the present invention, in a display device provided with the frame division drive and emphasis drive, a good display quality can be obtained while pseudo contour lines and color shift are suppressed, by controlling the emphasis drive separately for each of frame-divided fields.

DETAILED DESCRIPTION OF THE EMBODIMENTS

Figure 1A:
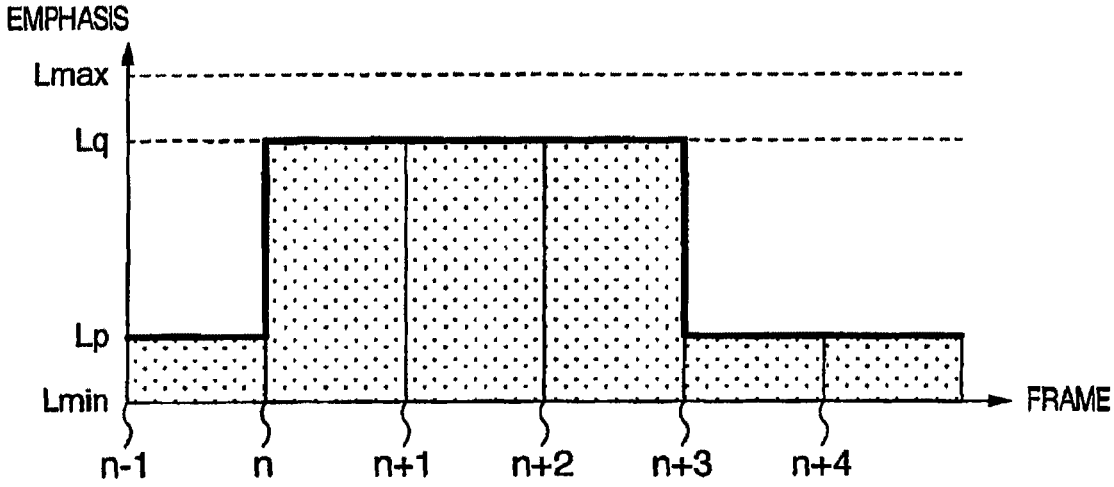
FIG.1A Prior Art
FIGS. 1A and 1B are graphs showing examples of changes in input display data of a display device and output display data obtained by subjecting the input display data to the frame division drive.

FIG. 1A is a graph showing a change in input display data. The abscissa represents a frame, i.e., a time. A period of one frame is, for example, 16.6 ms for a National Television Standards Committee (NTSC) signal of television. The input display data of a display device changes in the unit of one frame period. The ordinate represents a gray-scale of input display data. The input display data has one-to-one correspondence with the gray-scale. A gray-scale Lmax is a gray-scale corresponding to the maximum luminance the display device can display, and a gray-scale Lmin is a gray-scale corresponding to the minimum luminance the display device can display. The gray-scale corresponding to the maximum luminance corresponds to the maximum value of display data, i.e., an upper limit value of a dynamic range of display data, and the gray-scale corresponding to the minimum luminance corresponds to the minimum value of display data, i.e., a lower limit value of the a dynamic range of display data. The relation between the display data and luminance may be reversed.

FIG. 1A shows an example of input display data having a gray-scale Lp in the (n−1)-th frame, a gray-scale Lq from the n-th frame, and again the gray-scale Lp from the (n+3)-th frame. n is an integer of 1 or larger. For this input display data and for a display device without the frame division drive, a gray-scale voltage is supplied in the (n−1)-th frame so as to display the luminance corresponding to the gray-scale Lp, a gray-scale voltage is supplied from the n-th frame so as to display the luminance corresponding to the gray-scale Lq, and a gray-scale voltage is supplied from the (n+3)-th frame so as to display again the luminance corresponding to the gray-scale Lp. In this specification, a driving method of driving the display device in the frame unit by input display data input in the frame unit described above is defined as normal drive.

Next, the frame division drive will be described.

Figure 1B:
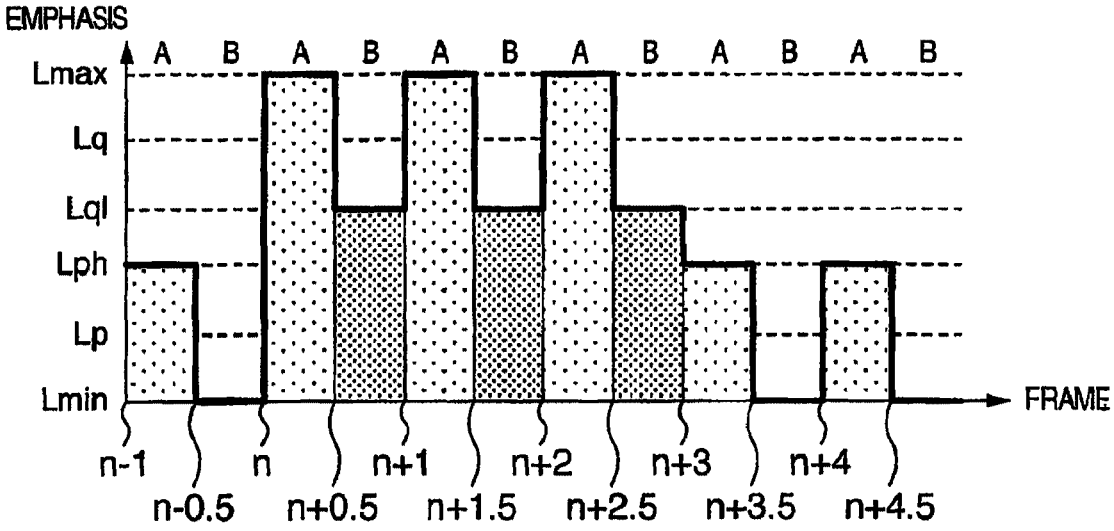
FIG.1B Prior Art

FIG. 1B is a graph showing an example of a change in output display data of the display device obtained by subjecting the input display data shown in FIG. 1A to the frame division drive. FIG. 1B shows an example in which one frame is divided into a field A and a field B. Relatively high gray-scale data, i.e., relatively high luminance data, is used for the field A, and relatively low gray-scale data, i.e., relatively low luminance data, is used for the field B. The gray-scale relation, i.e., luminance relation, between the field A and field B may be reversed. By displaying high gray-scale data, i.e., high luminance data and low gray-scale data, i.e., low luminance data in one frame period, a gray-scale (luminance) corresponding to externally input display data is realized in a pseudo manner. Therefore, the gray-scale (luminance) in the field A is equal to or higher than the gray-scale of luminance of externally input display data of one frame, and the gray-scale (luminance) in the field B is equal to or lower than the gray-scale of luminance of externally input display data of one frame. If the gray-scale or luminance of externally input display data of one frame is relatively high, it is preferable that the gray-scale (luminance) in the field A is the maximum gray-scale (maximum luminance), whereas if the gray-scale or luminance of externally input display data of one frame is relatively low, it is preferable that the gray-scale (luminance) in the field B is the minimum gray-scale (minimum luminance).

For example, for the input display data having the gray-scale Lp, the display device is driven by displaying a gray-scale Lph in the field A and a gray-scale Lmin in the field B, so that a viewer can sense the luminance corresponding to the gray-scale Lp in one frame period. The gray-scale Lph is equal to or higher than the gray-scale Lp. For the input display data having the gray-scale Lq, the display device is driven by displaying a gray-scale Lmax in the field A and a gray-scale Lql in the field B, so that a viewer can sense the luminance corresponding to the gray-scale Lq in one frame period. The gray-scale Lql is equal to or lower than the gray-scale Lq. In the frame division drive, it is preferable to use a frame memory when a frame is divided into fields. By driving the display device in the manner described above, a hold-type display device with the frame division drive can realize impulse type display.

Description will be made on a display device driving method combining the emphasis drive with both the normal drive and frame division drive.

Figure 2A:
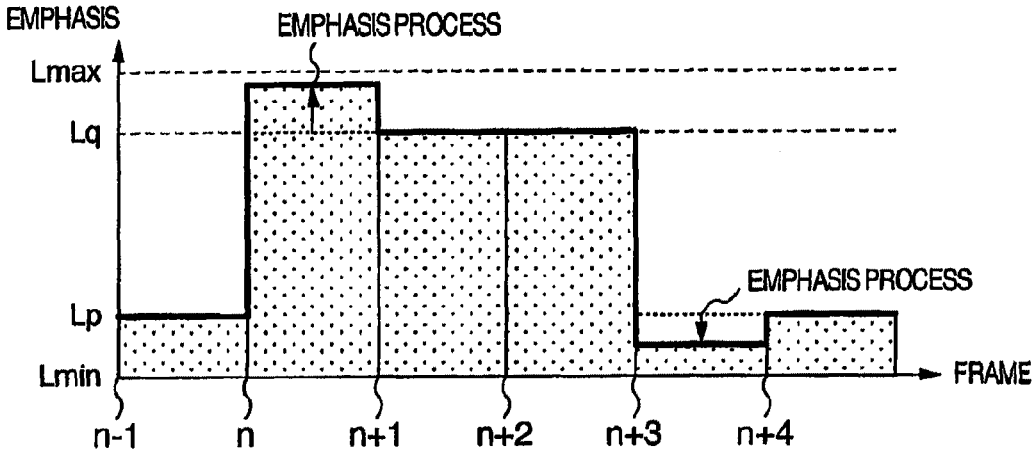
FIG.2A Prior Art
FIGS. 2A to 2C are graphs showing examples of changes in output display data obtained by subjecting input display data shown in FIGS. 1A and 1B to the conventional emphasis drive and output display data obtained through emphasis drive adopting the present invention.

FIG. 2A is a graph showing an example of a change in output display data of a display device combining the input display data shown in FIG. 1A with the emphasis drive.

In FIG. 2A, a change in data by the emphasis process is indicated by arrow symbols. Since the gray-scale changes from Lp to Lq in the n-th frame, emphasis data (correction data) is added (corrected) in order to emphasize the change. Since the gray-scale changes from Lp to Lq in the n-th frame, an emphasis process is added in order to emphasize the change. Since the gray-scale changes from Lq to Lp in the (n+3)-th frame, the emphasis process is added to emphasize this change. In the emphasis drive, it is preferable to use a frame memory to detect a change in input display data. As described above, in the emphasis drive, the display panel is driven by using output display data obtained by subjecting the input display data to the emphasis process to thereby improve an apparent response speed. In the emphasis drive, the emphasis data is increased to some extent, an insufficient luminance to be caused by a change in display data between frames can be compensated, so that a desired gray-scale (luminance) corresponding to the input display data can be displayed.

Next, an example of a combination of the frame division drive and emphasis drive will described.

Figure 2B:
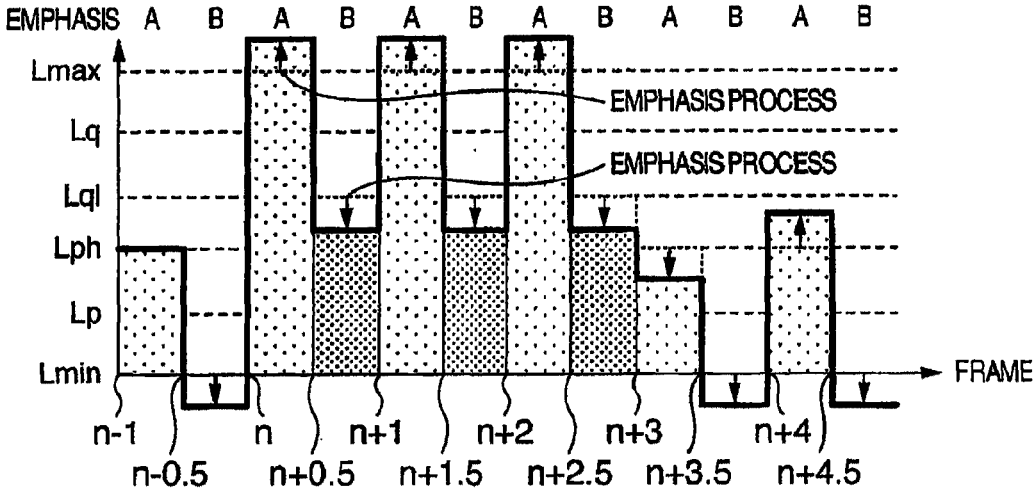
FIG.2B Prior Art

FIG. 2B shows an example in which the input display data shown in FIG. 1A is subjected to the frame division drive and emphasis drive.

If the emphasis drive is to be simply combined with the frame division drive, the gray-scale of display data of the present field is increased or decreased in accordance with a difference between display data one field before and display data of the present field. In the frame division drive, even if there is no change in the input display data, data for driving the display panel or the gray-scale voltage to be supplied to the display panel changes with a field in many cases because fields having different gray-scales are used in one frame. If the emphasis drive is applied directly to the input display data train of this type, data is emphasized in each field. More specifically, as indicated by arrow symbols in FIG. 2B, emphasis data in a gray-scale increase direction (display data of the present field added with correction data) and emphasis data in a gray-scale decrease direction (display data of the present field subtracted by correction data) are alternately added.

As described above, in the frame division drive, in order to display a luminance corresponding to the input display data having the gray-scale Lq, the display device is driven by displaying the gray-scale Lmax in the field A and the gray-scale Lql in the field B. In this case, if the correction data for the emphasis drive is added to the gray-scale Lmax in the field A, the total data exceeds the allowable maximum gray-scale of the display device, so that the correction data cannot be displayed actually. The emphasis drive can be applied to the gray-scale Lql in the field B. Therefore, a gray-scale balance between the field A and field B is lost and a desired gray-scale corresponding to the input display data cannot be displayed, so that pseudo contour lines and color shift which do not essentially exist are visually sensed. Similarly, in order to display the gray-scale Lp in the frame division drive, the display device is driven by displaying the gray-scale Lph in the field A and the gray-scale Lmin in the field B. In this case, if the correction data for the emphasis drive is added to the gray-scale Lmin in the field B, the total data becomes lower than the allowable minimum gray-scale of the display device, so that the correction data cannot be displayed actually. The emphasis drive can be applied to the gray-scale Lph in the field A. Therefore, a gray-scale balance between the field A and field B is lost and a desired gray-scale corresponding to the input display data cannot be displayed, so that pseudo contour lines and color shift which do not essentially exist are visually sensed. Since the emphasis process is executed after the frame division process, a frame memory for the frame division process and a frame memory for the emphasis process are required separately.

According to the present invention, the field division drive and emphasis drive are used in the following manner.

Figure 2C:
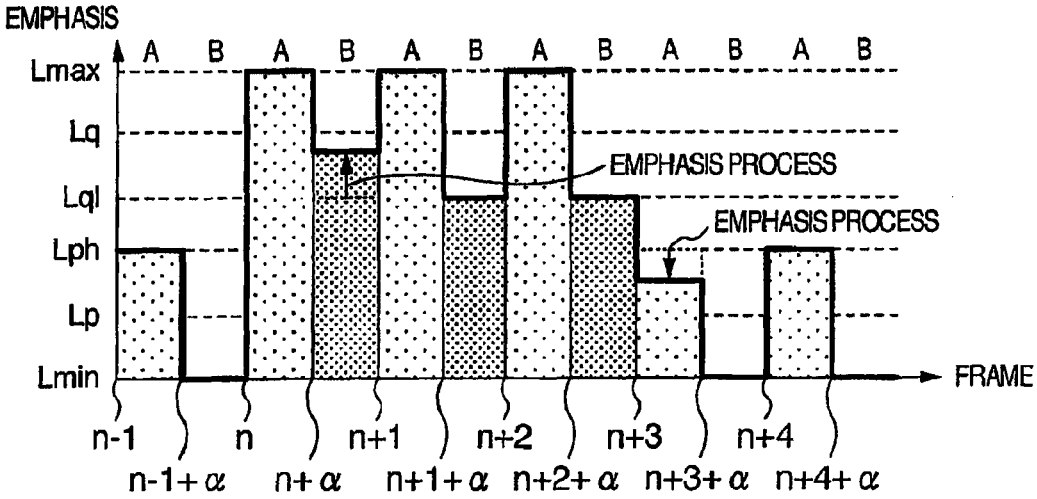

FIG. 2C shows an example of output display data obtained by applying the present invention to the input display data shown in FIG. 1A.

First, the input display data shown in FIG. 1A is subjected to the field division process. The input display data subjected to the field division process becomes the input display data shown in FIG. 1B as described above. In this case, one frame is divided into two fields: the field A and field B. In FIG. 2C, a change in data by the emphasis process is indicated by arrow symbols. Description will be made on the case in which the input display data changes from a low gray-scale to a high gray-scale, i.e., from a low pixel luminance to a high pixel luminance, i.e., from a dark pixel to a bright pixel. As shown in FIG. 1A, the input display data has the gray-scale Lp in the (n−1)-th frame and the gray-scale Lq in the n-th frame.

The output display data to the display panel after the field division drive has the gray-scale Lph in the field A of the (n−1)-th frame and the gray-scale Lmin in the field B of the (n−1)-th frame. The output display data has the gray-scale Lmax in the field A of the n-th frame and the gray-scale Lql in the field B of the n-th frame. The emphasis process is executed by paying attention to that the input display data changes from the gray-scale Lp in the (n−1)-th frame to the gray-scale Lq in the n-th frame. In this case, the field A of the n-th frame has the gray-scale Lmax, so that the gray-scale cannot be increased. In this case, instead of changing the gray-scale in the field A of the n-th frame, the gray-scale in the field B of the n-th frame is changed to Lql. In this case, the gray-scale Lql is changed, and for example, a gray-scale higher than the gray-scale Lql is output. In this manner, the luminance of the n-th frame sensed by the viewer of the display device is a luminance combining the luminance of the field A having the gray-scale Lmax and the luminance of the field B subjected to the emphasis process, and it is therefore possible to drive the display device by emphasizing the luminance change in the input display data.

Under the control by the emphasis drive shown in FIG. 2B, a gray-scale higher than Lmax (in excess of the allowable display range) is output to the field A of the n-th frame and a gray-scale smaller than the gray-scale Lql is output to the field B of the n-th frame. The emphasis drive of the present invention shown in FIG. 2C is different from the above-described control in that the gray-scale Lmax itself is output to the field A of the n-th frame and a gray-scale higher than the gray-scale Lql is output to the field B of the n-th frame.

Similarly, with reference to FIG. 2C, description will be made on the case in which the input display data changes from a high gray-scale to a low gray-scale. The input display data has the gray-scale Lq in the (n+2)-th frame and the gray-scale Lp in the (n+3)-th frame. After the field division drive, the output display data to the display panel has the gray-scale Lmax in the field A of the (n+2)-th frame and the gray-scale Lql in the field B of the (n+2)-th frame. The output display data has the gray-scale Lph in the field A of the (n+3)-th frame and the gray-scale Lmin in the field B of the (n+3)-th frame. The emphasis process is executed by paying attention to that the input display data changes from the gray-scale Lq in the (n+2)-th frame to the gray-scale Lp in the (n+3)-th frame. In this case, the gray-scale Lmin in the field B of the (n+3)-th frame cannot be changed to a lower gray-scale. Instead of changing the gray-scale in the field B of the (n+3)-th frame, the gray-scale Lph in the field A of the (n+3)-th frame is changed. The gray-scale Lph is changed, for example, to output a gray-scale lower than the gray-scale Lph. In this manner, the luminance of the (n+3)-th frame sensed by the viewer of the display device is a luminance combining the luminance of the field B having the gray-scale Lmin and the luminance of the field A subjected to the emphasis process to the gray-scale Lph, so that it is possible to drive the display device by emphasizing the luminance change in the input display data.

Under the control by the emphasis drive shown in FIG. 2B, a gray-scale lower than Lmin (in excess of the allowable display range) is output to the field B of the (n+3)-th frame and a gray-scale smaller than the gray-scale Lph is output to the field A of the (n+3)-th frame. The emphasis drive of the present invention shown in FIG. 2C is different from the above-described control in that the gray-scale Lmin itself is output to the field B of the (n+3)-th frame and a gray-scale lower than the gray-scale Lph is output to the field A of the (n+3)-th frame.

As described above, FIG. 2C shows an example in which one frame period is divided into two fields, the field A and field B. The time may not be divided by an equal pitch. Namely, the field period of the field A may not be equal to the field period of the field B. In the example shown in FIG. 2C, a ratio of the period of the field A to the period of the field B is set to $\alpha$: 1-$\alpha$ ($0<\alpha<1$). The emphasis control by the emphasis drive is preferably determined separately for each field by considering that fields have different field periods. It is preferable to reduce the amount of the emphasis control because as the field period prolongs, a write time of a gray-scale voltage to each pixel prolongs.

Next, specific embodiments realizing the drive method of the present invention will be described.

The first embodiment provides a display device having the structure that an emphasis circuit is disposed between a speed doubling circuit for realizing the frame division drive and a field conversion circuit.

The second embodiment provides a display device having the structure that an emphasis circuit is used prior to executing a frame division process by a speed doubling circuit and a field conversion circuit. Namely, the order of the process by the speed doubling circuit and the process by the emphasis circuit may be set as desired. Therefore, a combination of the speed doubling circuit and emphasis circuit may be used as the conversion circuit.

First Embodiment The first embodiment of the present invention will be described with reference to FIGS. 3 and 4.

Figure 3:
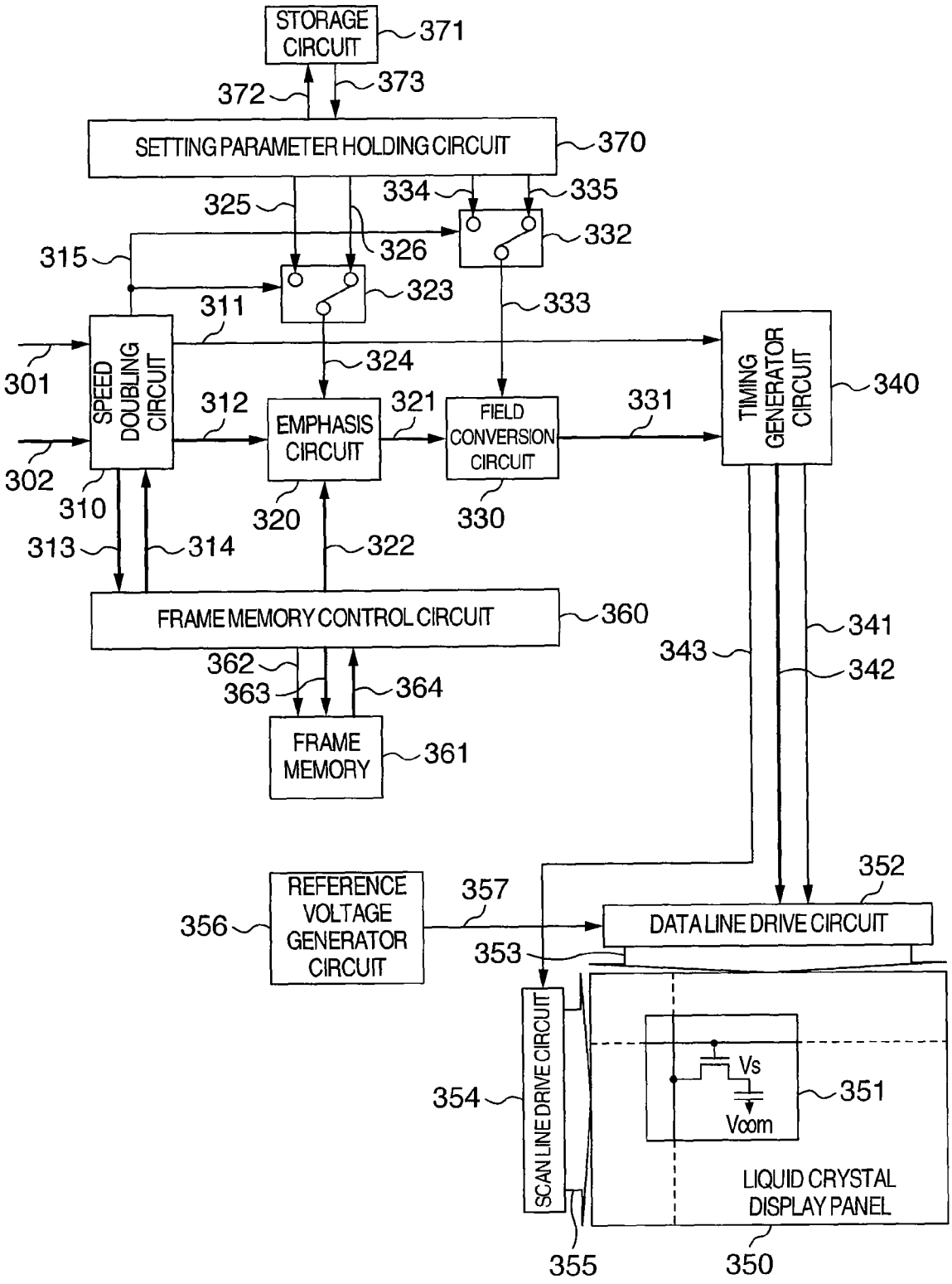
FIG. 3 is a diagram showing an example of the structure of a display device according to a first embodiment of the present invention.

FIG. 3 is a diagram showing an example of the structure of a display device according to the first embodiment of the present invention. FIG. 4 is a diagram showing an example of the operation of the display device according to the first embodiment and shows a timing chart for the display device shown in FIG. 3. In the following description, the frame division drive divides one frame into two fields, a field A and a field B, by way of example. If the number of frame division is made large, a write time of a gray-scale voltage to each pixel becomes long and a desired gray-scale cannot be obtained. It is therefore preferable that although the number of frame division is two, it may be three or four. The number of frame division is m (m is an integer of 2 or larger). The display device is provided with field division drive and emphasis drive. Even if both the drives are combined, good moving image display can be realized without losing a gray-scale balance.

The display device is constituted of: a speed doubling circuit 310 for driving at double speed a timing generator circuit 340, a data line drive circuit 352 and a scan line drive circuit 354; an emphasis circuit 320 for emphasizing display data; a field conversion circuit 330 for converting display data of one frame into display data of m fields; the timing generator circuit 340 for generating control signals for the data line drive circuit 352 and scan line drive circuit 354; a frame memory control circuit 360 for controlling read/write of display data relative to a frame memory 361; the frame memory 361 for temporarily storing display data; an emphasis parameter selector circuit 323 for selecting an emphasis parameter for emphasizing display data; a field conversion parameter selector circuit 332; a setting parameter holding circuit 370 for holding various setting parameters; a storage circuit 371; the data line drive circuit 352 for supplying a gray-scale voltage (display signal) to data lines of a liquid crystal display panel 350 to drive the data lines; the scan line drive circuit 354 for supplying a scan select signal to scan lines of the liquid crystal display panel 350 to drive the scan lines; the liquid crystal display panel 350 having a plurality of data lines, a plurality of scan lines crossing the plurality of data lines and a plurality of pixels disposed in a matrix shape and connected to the plurality of data lines and scan lines; and a reference voltage generator circuit 356 for generating a reference voltage for the gray-scale voltage.

The display device is provided with a function of receiving an input of input display data 302 and an input control signal group 301, subjecting the input display data 302 and input control signal group 301 to the frame division drive and emphasis drive to thereby drive the liquid crystal display panel 350. The input control signal group 301 is constituted of: for example, a vertical sync signal for defining one frame period (period during which one screen is displayed); a horizontal sync signal for defining one horizontal scan period (period during which one line is displayed); a data valid period signal for defining a valid period of display data; a reference clock signal synchronous with display data; and the like. The input display data 302 and input control signal group 301 are transferred from an external system (e.g., TV, PC, mobile phone and the like).

The speed doubling circuit 310 is a circuit for generating speed-doubled data 312 having a frame frequency of the input display data 302 multiplied by m. More specifically, the speed doubling circuit 310 sequentially stores the input display data 302 in the frame memory 361. When the stored data of one frame period is to be read, the data is read during one frame period divided by m, i.e., during a first period, a second period, a third period, . . . , an m-th period. Since the same display data is read m times during one frame period, the frame frequency can be multiplied by m. In the following description, it is assumed that m=2. The input display data read first time is used as speed-doubled data for the field A, and the input display data read second time is used as speed-doubled data for the field B.

Reference numeral 313 represents data to be written in the frame memory 361, and reference numeral 314 represents data to be read from the frame memory 361. The speed doubling circuit 310 generates also a field judgement signal 315 and a speed doubling control signal group 311. The field judgement signal 315 is synchronous with the speed-doubled data 312, and is used to judge whether the speed-doubled data 312 is speed-doubled data for the field A or for the field B. The speed doubling control signal group 311 is constituted of: for example, a speed-doubled vertical sync signal for defining one field period; a speed-doubled horizontal sync signal for defining one horizontal scan period; a speed-doubled data effective period signal for defining an effective period of the speed-doubled data; a speed-doubled clock signal synchronous with the speed-doubled data 312; and the like. The frame memory control circuit 360 is provided with a function of controlling the frame memory 361 and is a circuit for arbitrating a data write access group and a data read access group among the speed doubling circuit 310, emphasis circuit 320 and frame memory 361. The frame memory 361 is controlled by a memory control signal group 362. As described above, according to the display device of the present invention, a data access necessary for a speed doubling process and an emphasis process can be shared by using the frame memory control circuit 360. It is therefore possible to reduce the capacity of the frame memory 360 and an access amount: Namely, according to the configuration of the present invention, it is possible to reduce a circuit scale and the number of chips and configure the display device at lower cost, more than the configuration that frame memories for the speed doubling process and for the emphasis process are prepared separately.

The frame memory 361 is preferably a memory device having a capacity capable of storing display data of at least two frames, and performs a data read/write process in accordance with the memory control signal group 362. Dynamic Random Access Memories (DRAM) of various types and the like may be used as the frame memory 361. Reference numeral 363 represents data to be written in the frame memory, and reference numeral 364 represents data to be read from the frame memory. The emphasis circuit 320 is a circuit for generating emphasis data 321 necessary for the emphasis drive. The emphasis circuit receives the speed-doubled data 312 of the frame output from the speed doubling circuit 310, and instructs the frame memory control circuit 360 to read speed-doubled data 322 one frame period before the speed-doubled data 312 from the frame memory 361 synchronously with an input of the speed-doubled data 312. Reference numeral 322 represents data to be read from the frame memory 361. The emphasis circuit 320 performs data conversion for the emphasis drive of the speed-doubled data 312 to generate emphasis data 321 on the basis of the relation between the speed-doubled data 312 and speed-doubled data 322 one frame period before and in accordance with a predetermined emphasis rule. The emphasis rule is input as an emphasis parameter 324 to the emphasis circuit 320. An emphasis parameter selector 323 selects the emphasis parameter 324 to be input to the emphasis circuit 320. A field is distinguished by using a field judgement signal 315 to select the parameter for each field. An emphasis parameter A 325 decides the emphasis rule for the field A. An emphasis parameter B 326 decides the emphasis rule for the field B. If the frame division drive divides one frame into m fields, it is preferable to prepare the emphasis parameter for each field. The emphasis rule is decided properly so as to obtain a good image quality without generating pseudo contour lines and color shift, by considering influence by the number of frame division, a value of speed-doubled data, a value of speed-doubled data one frame period before, an environmental temperature of the display device, a temperature of the liquid crystal panel, a setting amount of the reference voltage, a length of one frame period, a length of each field period, a color of speed-doubled data, and the like. The emphasis rule may be defined by an equation using the above-described various conditions as parameters, or by referring to a look-up table using the above-described various conditions as indices.

The field conversion circuit 330 is a circuit for generating field data necessary for the frame division drive. The field conversion circuit receives emphasis data 321 for each field output from the emphasis circuit 320, and converts the emphasis data into field conversion data 331 for each field in accordance with a predetermined field conversion rule. The field conversion rule is input as a field conversion parameter 333 to the field conversion circuit 330. A field conversion parameter selector 332 selects the field conversion parameter 333 to be input to the field conversion circuit 330. A field is distinguished by using the field judgement signal 315 to select the parameter for each field. A field conversion parameter A 334 decides the field conversion rule for the field A. A field conversion parameter B 335 decides the field conversion rule for the field B. If the frame division drive divides one frame into m fields, it is preferable to prepare the field conversion parameter for each field. The field conversion rule is decided properly so as to obtain a good image quality without generating pseudo contour lines and color shift, by considering the influence by the number of frame division, a value of speed-doubled data, a value of speed-doubled data one frame period before, an environmental temperature of the display device, a temperature of the liquid crystal panel, a setting amount of the reference voltage, a length of one frame period, a length of each field period, a color of speed-doubled data, and the like. The field conversion rule may be defined by an equation using the above-described various conditions as parameters, or by referring to a look-up table using the above-described various conditions as indices.

The timing generator circuit 340 is a circuit for generating a data line drive circuit control signal group 341 for controlling the data line drive circuit 352, output display data 342, and a scan line drive circuit control signal group 343 for controlling the scan line drive circuit 354. The timing generator circuit 340 receives the speed-doubled control signal group 311 output from the speed doubling circuit 310 and the field conversion data 331 output from the field conversion circuit 330. The timing generator circuit generates the data line drive circuit control signal group 341, output display data 342 and scan line drive circuit control signal group 343, by using the speed-doubled control signal group 311 and field conversion data 331.

The setting parameter holding circuit 370 is a circuit for holding various setting parameters to be used by the emphasis circuit 320 and field conversion circuit 330, and is also provided with a function of reading the various setting parameters from the storage circuit 371. The setting parameter holding circuit 370 has a storage device group such as register files and Random Access Memories (RAM) of various types, and a control circuit for the storage circuit 371. Reference numeral 372 represents a control signal group for the storage circuit 371, and reference numeral 373 represents various setting parameters read from the storage circuit 371. The storage circuit 371 is a circuit for storing the various setting parameters. The storage circuit may use various nonvolatile memories such as Read-Only Memories (ROM), Electrically Erasable Programmable ROM (EEPROM) and flash memories.

The data line drive circuit signal group 341 is constituted of: for example, an output timing signal for defining an output timing of a gray-scale voltage corresponding to display data; an alternating signal for determining a polarity of a source voltage; a clock signal synchronous with display data; and the like. The scan line drive circuit control signal group 343 is constituted of: for example, a shift signal for defining a scan period of one line; a vertical start signal for defining a scan start of a top line; and the like. Reference numeral 357 represents a reference voltage. The data line drive circuit 352 generates a potential corresponding to the number of display gray-scale levels by using the reference voltage 357, selects a potential of one level corresponding to the output display data 342, and applies the potential as a data voltage to the liquid crystal display panel 350. Reference numeral 353 represents a data voltage generated by the data line drive circuit. Reference numeral 355 represents a scan line select signal. The scan line drive circuit 354 generates a scan line select signal 355 by using the scan line drive circuit control signal group 348, and outputs the scan line select signal to the liquid crystal display panel 350.

Reference numeral 351 represents a schematic diagram showing one pixel of the liquid crystal display panel. One pixel of the liquid crystal display panel 350 is constituted of a Thin Film Transistor (TFT) having a source electrode, a gate electrode and a drain electrode, a liquid crystal layer, and an opposing electrode. As a scan signal is applied to the gate electrode, a switching operation of TFT is performed. In the open state of TFT, a data voltage is written to the source electrode connected to the liquid crystal layer from the drain electrode, and in the close state of TFT, voltage written to the source electrode is held. A voltage at the source electrode is represented by Vs, and an opposing electrode voltage is represented by VCOM. The liquid crystal layer changes its polarization direction in accordance with a potential difference between the source electrode voltage Vs and opposing electrode voltage VCOM. By disposing a polarizer on the bottom and top surfaces of the liquid crystal layer, an optical transmission amount of a back light disposed on the bottom of the liquid crystal display panel changes to realize gray-scale display.

Next, with reference to FIG. 4, description will be made on the operation of each circuit portion of the display device of the present invention.

Figure 4:
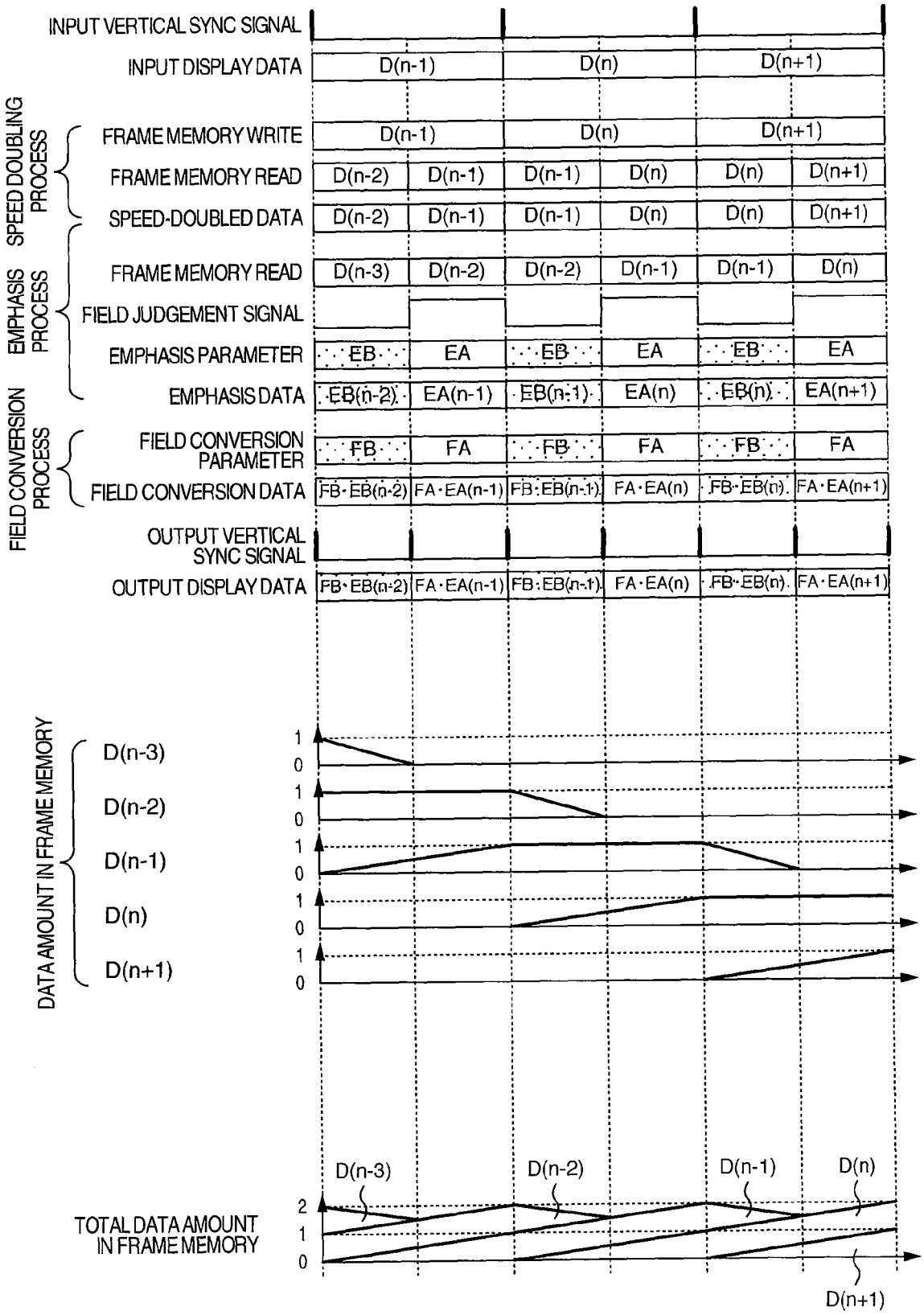
FIG. 4 is a diagram showing an example of the operation of the display device according to the first embodiment of the present invention.

FIG. 4 is a diagram showing an example of a timing chart illustrating the operation of the display device shown in FIG. 3. The abscissa represents a time. An example of a signal waveform group at each circuit portion of the display device is shown in an upper area of FIG. 4.

First, input display data and an input control signal group are input from the external system. In FIG. 4, an input vertical sync signal of the input control signal group is shown. The input vertical sync signal is a signal for defining one frame period. In FIG. 4, a symbol D(n) represents input display data of the n-th frame. Similarly, for example, D(n−1) represents input display data of the (n−1)-th frame. The input display data in each frame is sequentially is sequentially input in the unit of one frame period, such as, . . . D(n−1), D(n), D(n+1), . . . .

Next, the speed doubling circuit 310 executes a speed doubling process. The speed doubling circuit 310 instructs the frame memory control circuit 360 to sequentially write the input display data 302 in the frame memory 361. In this case, the order of data to be written in the frame memory 361 is, . . . D(n−1), D(n), D(n+1), . . . in the unit of one frame period. On the other hand, the speed doubling circuit 310 instructs the frame memory control circuit 360 to read data written in the frame memory 361. In this case, the order of data to be read from the frame memory 361 is, . . . D(n−2), D(n−1), D(n−1), D(n), D(n), D(n+1), . . . in the unit of one field period obtained by halving one frame period. The speed doubling circuit 310 outputs the data read from the frame memory 361 as the speed-doubled data 312. The speed doubling circuit 310 generates also the field judgement signal 315. The field judgement signal 315 is used for judging a field, as described earlier. In this embodiment, since one frame is divided into two fields, fields A and B, the field judgement signal 315 is constituted of a signal toggling two levels: a signal level representative of the field A and a signal level representative of the field B, every one field period.

Next, the emphasis circuit 320 executes the emphasis process for the speed-doubled data 312. The emphasis circuit 320 receives the speed-doubled data 312 output from the speed doubling circuit 310, and instructs the frame memory control circuit 360 to read input display data one frame before the speed-doubled data in one field period from the frame memory, synchronously with an input of the speed-doubled data 312. For example, if the speed-doubled data of the n-th frame is input from the speed doubling circuit 310, the emphasis circuit 320 instructs the frame memory control circuit 360 to read data of the (n−1)-th frame from the frame memory 361 synchronously with the input of the speed-doubled data. The emphasis circuit generates the emphasis data 321 by using the data 322 read from the frame memory 361 and the emphasis parameter 324 properly selected and input from the emphasis parameter selector 323 in accordance with the field judgement signal 315.

In FIG. 4, a symbol EA represents the emphasis parameter A for the field A, and a symbol EB represents the emphasis parameter B for the field B. In FIG. 4, a symbol EA(n) represents the emphasis data for the field A of the n-th frame. Similarly, for example, EA(n−1) represents the emphasis data for the field A of the (n−1)-th frame. In FIG. 4, a symbol EB(n) represents the emphasis data for the field B of the n-th frame. Similarly, for example, EB(n−1) represents the emphasis data for the field B of the (n−1)-th frame. For example, if the speed-doubled data 312 is input in the order of, . . . D(n−2), D(n−1), D(n−1), D(n), D(n), D(n+1), . . . in the unit of one field period, the speed-doubled data is read from the frame memory 361 in the order of, . . . D(n−3), D(n−2), D(n−2), D(n−1), D(n−1), D(n), . . . . In this case, the emphasis parameter selector 323 selects the emphasis parameters 324 in the order of, . . . EB, EA, EB, EA, EB, EA, . . . in accordance with the field judgement signal 315, and inputs the emphasis parameters to the emphasis circuit 320. In accordance with these signals, the emphasis circuit executes the emphasis process to generate the emphasis data 321 in the order of, . . . EB(n−2), EA(n−1), EB(n−1), EA(n), EB(n), EA(n+1), . . . .

Next, the field conversion circuit 330 executes the field conversion process for the emphasis data 321. The field conversion circuit 330 receives the emphasis data 321 output from the emphasis circuit 320, and generates the field conversion data 331 by using the field conversion parameter 333 properly selected and input from the field conversion parameter selector 332 in accordance with the field judgement signal 315.

In FIG. 4, a symbol FA represents the field conversion parameter A for the field A, and a symbol EB represents the field conversion parameter B for the field B. In FIG. 4, a symbol FA·EA(n) represents the emphasis data in the field A of the n-the frame after the field conversion. Similarly, for example, FA·EA(n−1) represents the emphasis data in the field A of the (n−1)-th frame after the field conversion. In FIG. 4, a symbol FB·EB(n) represents the emphasis data in the field B of the n-th frame after the field conversion. Similarly, for example, FB·EB(n−1) represents the emphasis data in the field B of the (n−1)-th frame after the field conversion. For example, if the emphasis data 321 is input in the order of, . . . EB(n−2), EA(n−1), EB(n−1), EA(n), EB(n), EA(n+1), . . . , the field conversion parameter selector 332 selects the field conversion parameters in the order of, . . . FB, FA, FB, FA, FB, FA, . . . in accordance with the field judgement signal 315, and inputs the field conversion parameters to the field conversion circuit 330. The field conversion circuit generates and outputs the field conversion data 331 in the order of, . . . FB·EB(n−2), FA·EA(n−1), FB·EB(n−1), FA·EA(n), FB·EB(n), FA·EA(n+1), . . . .

Lastly, the timing generator circuit 340 generates output display data 342 by using the field conversion data 331. The timing generator circuit 340 generates also the output control signal groups 341 and 343 by using the speed-doubled control signal group 311 generated by the signal doubling circuit 310. In FIG. 4, an output vertical sync signal of the output control signal groups 341 and 343 is shown. The output vertical sync signal is a signal for defining one field period.

The lower area in FIG. 4 shows a graph indicating a change in the data amount in the frame memory 361. The abscissa represents a frame (i.e., time) and the ordinate represents a data amount. A data amount of one frame is indicated by 1.

The frame memory 361 stores and holds data of each frame during a period necessary for processing at each circuit. Data of an unnecessary frame is sequentially discarded or new frame data is overwritten. For example, in the case of data D(n−1) of the (n−1)-th frame, as the data input of the (n−1)-th frame starts, the data amount in the frame memory increases gradually. When the data input of the (n−1)-th frame is completed, data of one frame is stored in the frame memory 361. In this case, during the second half period of the (n−1)-th frame, a write operation of data of the (n−1)-th frame is performed and also a read operation of data of the (n−1)-th frame is performed at double speed for the speed doubling process. During the period while data of the n-th frame is input, the data in the (n−1)-th frame is held. During this period, a data amount of the (n−1)-th frame in the frame memory 361 will not change. In this case, an operation of holding the data in the (n−1)-th frame is performed and also an operation of reading the data in the (n−1)-th frame at double speed is performed for the speed doubling process and emphasis process. Thereafter, during the period while data of the (n+1)-th frame is input, since the first half of the frame period is used for the emphasis process, data of the (n−1)-th frame is read at double speed. Thereafter, the data of the (n−1)-th frame becomes unnecessary. Therefore, the data of the (n−1)-th frame is sequentially discarded or new data is overwritten. In this manner, when the first half of the (n+1)-th frame is completed, the data amount of the (n−1)-th frame in the frame memory 361 is 0.as described above, data of each frame is subjected to three stages: write, hold and discard and is stored in the frame memory 361 during 2.5 frame periods in total. A series of operations described above is always executed for each frame. A change in the data amount of each frame in the frame memory 361 has been described above.

The lowermost area of FIG. 4 shows a graph indicating a change in a total data amount of each frame. As shown, although there is a variation in the data amount, the total data amount will not exceed two frames. Namely, the display device of the present invention can be realized if the frame memory 361 has a capacity of two frames.

Figure 5:
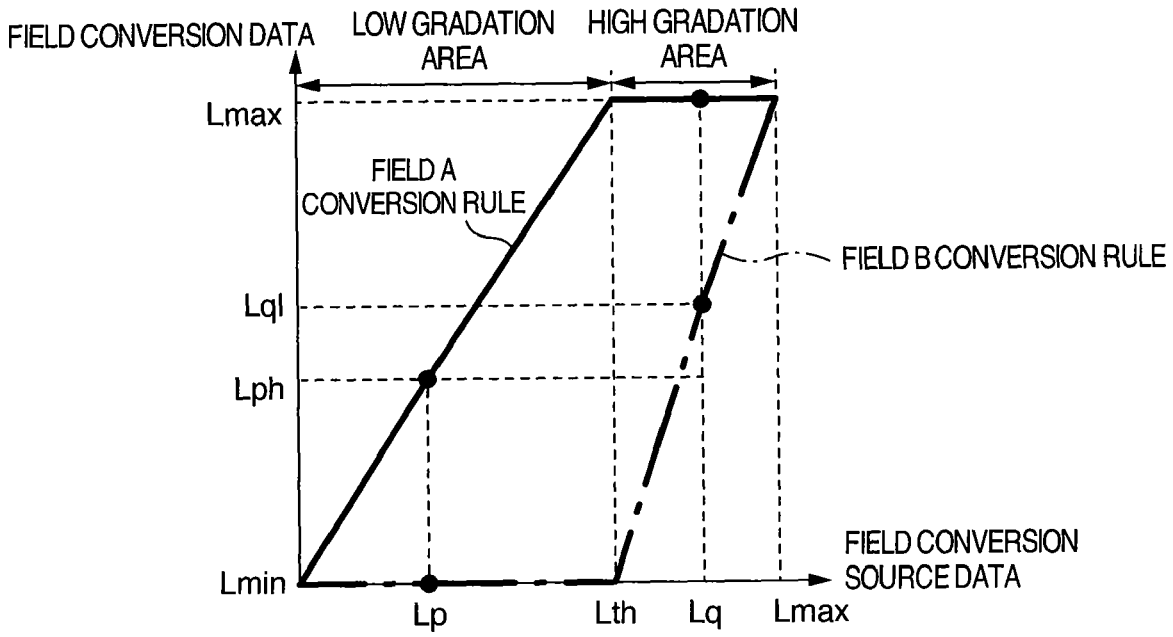
FIG. 5 is a diagram showing field conversion rules to be used for the frame division drive according to the first and second embodiments of the present invention.

FIG. 5 is a diagram showing an example of field conversion rules to be used when the field conversion circuit 330 of the display device of the present invention executes the field conversion process. The abscissa represent field conversion source data before the field conversion and the ordinate represents field conversion data after the field conversion. In the first embodiment, the field conversion source data corresponds to the emphasis data 321, and the field conversion data after the field conversion corresponds to the field conversion data 331. In FIG. 5, an example of the conversion rule for the field A is indicated by a bold line and an example of the conversion rule for the field B is indicated by one-dot chain line. In the example shown in FIG. 5, the field conversion rule is roughly divided into two areas: a low gray-scale area (low luminance area) and a high gray-scale area (high luminance area). The area where the field conversion source data has a gray-scale lower than a gray-scale Lth, is called the low gray-scale area, whereas the area where the field conversion source data has a gray-scale higher than the gray-scale Lth, is called the high gray-scale area. The gray-scale Lth at the border between the low gray-scale area and high gray-scale area of liquid crystal is not a center between Lmax and Lmin, but at the position on the Lmax side spaced from the center.

In the low gray-scale area, the field B is fixed to the gray-scale Lmin, and the field conversion data for the field A is selected in such a manner that a desired luminance is obtained during one frame period. For example, if the field conversion source data is Lp (Lp<Lth), the field conversion data for the field B is set to Lmin, and the field conversion data for the field A is set to Lph. The gray-scale Lph is a gray-scale capable of obtaining a luminance corresponding to the gray-scale to be obtained if the gray-scale Lp is displayed during one frame period, by displaying the gray-scale Lmin and gray-scale Lph in every one field period.

Similarly, in the high gray-scale area, the field A is fixed to the gray-scale Lmax, and the field conversion data for the field B is selected in such a manner that a desired luminance is obtained during one frame period. For example, if the field conversion source data is Lq (Lq>Lth), the field conversion data for the field A is set to Lmax, and the field conversion data for the field B is set to Lql. The gray-scale Lql is a gray-scale capable of obtaining a luminance corresponding to the gray-scale to be obtained if the gray-scale Lq is displayed during one frame period, by displaying the gray-scale Lql and gray-scale Lmax in every one field period.

Although the field conversion rules have two areas, the high gray-scale area and low gray-scale area with the gray-scale Lth being used as the border, the field conversion rules may have more areas or may be changed smoothly without providing definite areas. In this case, the field conversion data for the field A may having a gray-scale lower than Lmax and the field conversion data for the field B may have a gray-scale higher than Lmin. Instead of the gray-scale Lth having one value, gray-scale areas having a plurality of values may also be used.

Next, description will be made on the emphasis rule for the display device according to the first embodiment of the present invention.

Figure 6:
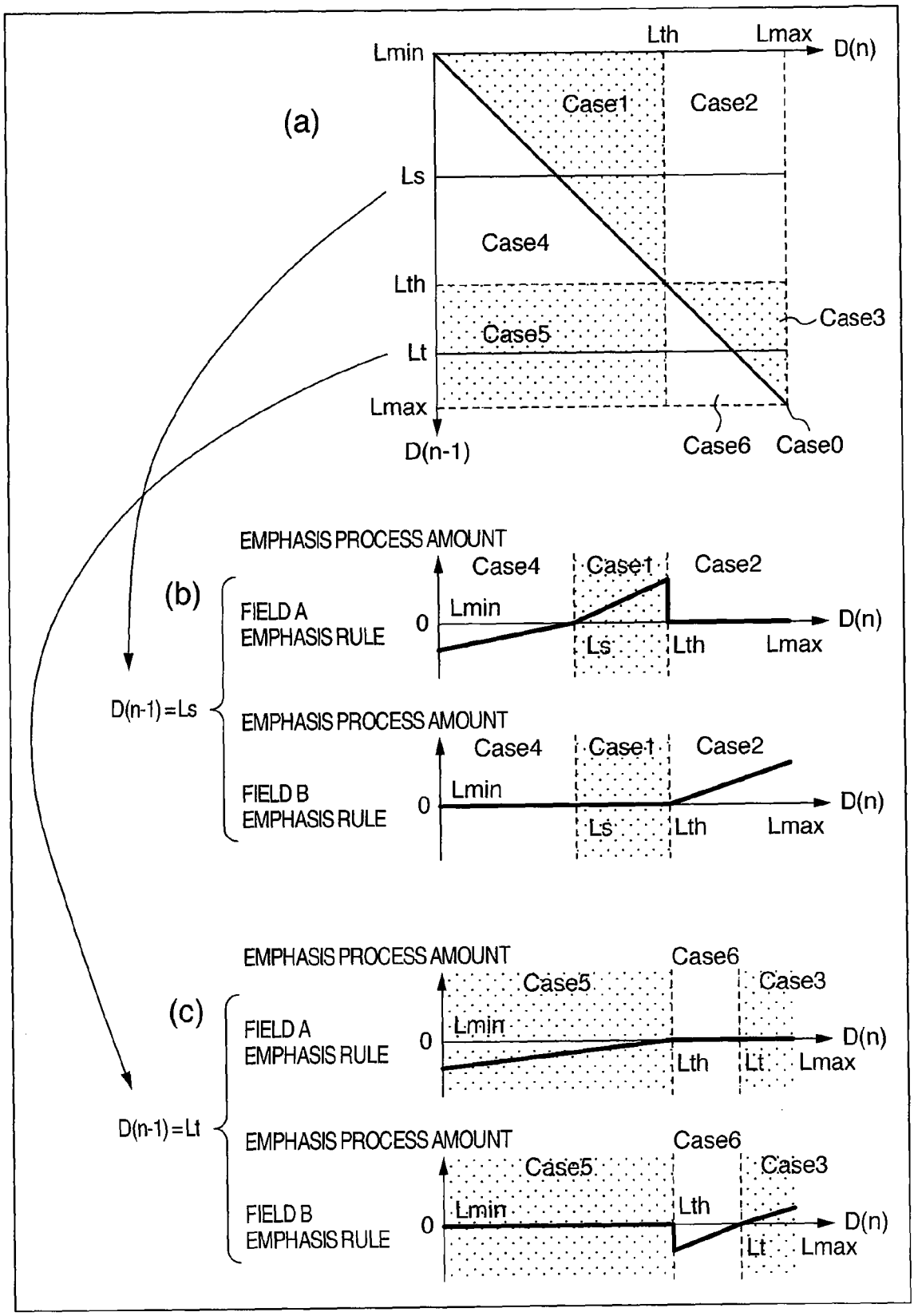
FIG. 6 is a diagram showing examples of emphasis rules used for the emphasis drive of the display device according to the first embodiment of the present invention.

A portion (a) in FIG. 6 is a diagram showing an example of the emphasis rule to be used when the emphasis circuit 320 of the first embodiment of the present invention executes the emphasis process. The abscissa represents speed-doubled data D(n) of the n-th frame, and the ordinate represents speed-doubled data D(n−1) of the (n−1)-th frame. The emphasis rule shown in the portion (a) is tightly related to the field conversion rule shown in FIG. 5. Description will be made on an example of the emphasis rule when the field conversion rule is defined by dividing the area into two areas by the gray-scale Lth shown in FIG. 5. The emphasis rule can be classified roughly into three cases, depending upon the magnitudes of D(n) and D(n−1).

If D(n)=D(n−1) is satisfied, there is no change in input display data between frames. In this case, since the emphasis process is not required to be executed, the emphasis process amount is 0. This case satisfying D(n)=D(n−1) is called Case 0.

If D(n)>D(n−1) is satisfied, a gray-scale changes increasing its value between frames. In this case, the emphasis process is executed to emphasize further an increase in the gray-scale. This emphasis process is called a rise emphasis process. The rise emphasis rule is further classified into three cases (Case 1, Case 2, Case 3) depending upon the magnitudes of D(n), D(n−1) and Lth.

Case 1 corresponds to D(n)<Lth and D(n−1)<Lth, Case 2 corresponds to D(n)>Lth and D(n−1)<Lth, and Case 3 corresponds to D(n)>Lth and D(n−1)>Lth.

If D(n)<D(n−1) is satisfied, a gray-scale changes decreasing its value between frames. In this case, the emphasis process is executed to emphasize further a decrease in the gray-scale. This emphasis process is called a fall emphasis process. The fall emphasis rule is further classified into three cases (Case 4, Case 5, Case 6) depending upon the magnitudes of D(n), D(n−1) and Lth.

Case 4 corresponds to D(n)<Lth and D(n−1)<Lth, Case 5 corresponds to D(n)<Lth and D(n−1)>Lth, and Case 6 corresponds to D(n)>Lth and D(n−1)>Lth.

As described above, the emphasis rule can be classified into seven cases, Case 0 to Case 6. In the seven Cases, the response characteristics of a luminance of liquid crystal are not always equal. For example, the liquid crystal response speed is different between the rise (gray-scale increase change) and fall (gray-scale decrease change). Therefore, the emphasis rule for executing a desired emphasis process is required to be determined properly for the seven cases, relative to the field conversion rule. For example, the emphasis rule is determined in the following manner.

In Case 0, since emphasis is not necessary, an emphasis amount is 0 (field A emphasis process amount=0, field B emphasis process amount=0).

In Case 1, the rise emphasis process is executed. In order to improve a moving image display quality, for example, the field conversion data for the field B of D(n) is maintained at Lmin, and the emphasis rule is determined in such a manner that the rise emphasis process is executed by using only the field conversion data for the field A of D(n). Namely, field A emphasis process amount>0 and field B emphasis process amount=0.

In Case 2, the rise emphasis process is executed. In this case, since the field conversion data of the field A of D(n) is Lmax, the rise emphasis process cannot be executed. Therefore, the field conversion data for the field A of D(n) is maintained at Lmax, and the emphasis rule is determined in such a manner that the rise emphasis process is executed by using only the field conversion data for the field B of D(n). Namely, field A emphasis process amount=0 and field B emphasis process amount>0.

From the same reason as that of Case 2, in Case 3 the field conversion data for the field A of D(n) is maintained at Lmax, and the emphasis rule is determined in such a manner that the rise emphasis process is executed by using only the field conversion data for the field B of D(n). Namely, field A emphasis process amount=0 and field B emphasis process amount>0. However, the display method of a luminance of D(n−1) is different between Case 2 and Case 3. Namely, since D(n−1) in Case 2 is in the low gray-scale area and D(n−1) in Case 3 is in the high gray-scale area, it is preferable to apply different emphasis rules to Case 2 and Case 3.

In Case 4, the fall emphasis process is executed. In this case, since the field conversion data of the field B of D(n) is Lmin, the fall emphasis process cannot be executed. Therefore, the field conversion data for the field B of D(n) is maintained at Lmin, and the emphasis rule is determined in such a manner that the fall emphasis process is executed by using only the field conversion data for the field A of D(n). Namely, field A emphasis process amount<0 and field B emphasis process amount=0.

From the same reason as that of Case 4, in Case 5 the field conversion data for the field B of D(n) is maintained at Lmin, and the emphasis rule is determined in such a manner that the fall emphasis process is executed by using only the field conversion data for the field A. Namely, field A emphasis process amount<0 and field B emphasis process amount=0. However, the display method of a luminance of D(n−1) is different between Case 4 and Case 5. Namely, since D(n−1) in Case 4 is in the low gray-scale area and D(n−1) in Case 5 is in the high gray-scale area, it is preferable to apply different emphasis rules to Case 4 and Case 5.

In Case 6, the fall emphasis process is executed. In order to improve a moving image display quality, for example, the field conversion data for the field A is maintained at Lmax, and the emphasis rule is determined in such a manner that the fall emphasis process is executed by using only the field conversion data for the field B. Namely, field A emphasis process amount=0 and field B emphasis process amount<0.

Specific examples will be described in more detail by using portions (b) and (c) in FIG. 6. The portions (b) and (c) are schematic diagrams showing the field A emphasis rule (upper row) and field B emphasis rule (lower row) in the form of emphasis process amount graphs. The abscissa of the portions (b) and (c) represent a value of D(n), and the ordinate represents an emphasis process amount. The emphasis process amount indicates a value of emphasis data to be added to D(n) for the emphasis process, and can take positive and negative values.

The portion (b) of FIG. 6 is a diagram showing an example of how the emphasis amount is determined in accordance with the value of D(n) if D(n−1) has a gray-scale Ls (Ls<Lth). As described earlier, the emphasis rule is classified into seven Cases. Since D(n−1)=Ls in the portion (b), the emphasis rule is Case 4 for D(n)<Ls, Case 0 for D(n) =Ls, Case 1 for Ls<D(n)<Lth, and Case 2 for Lth<D(n).

The portion (c) of FIG. 6 is a diagram showing an example of how the emphasis amount is determined in accordance with the value of D(n) if D(n−1) has a gray-scale Lt (Lt<Lth). As described earlier, the emphasis rule is classified into seven Cases. Since D(n−1)=Lt in the portion (c), the emphasis rule is Case 5 for D(n)<Lth, Case 6 for Lth <D(n)<Lt, Case 0 for D(n)=Lt, and Case 3 for Lt<D(n).

In the portions (b) and (c), although D(n−1) is Ls or Lt, D(n−1) may take a different value in order to set the emphasis rule. An example of the portions (b) and (c) is only illustrative. The emphasis rule may be set by using the emphasis process amount graphs having complicated curves. As described above, since the emphasis rule is tightly related to D(n), D(n−1) and field conversion rule (particularly Lth), the emphasis rule is adjusted by considering these values.

Factors other than the above-described three factors influencing a decision of the emphasis rule include, for example, the number of frame division, a temperature of the liquid crystal display panel, a γ value of the liquid crystal panel, a length of one frame period, a ratio between lengths of field periods, a color of display data and the like.

The number m of frame division is the number m of fields constituting one frame. For example, if a frame is divided into m fields, it is preferable to prepare m emphasis rules for the fields. Alternatively, one or more and m or less fundamental emphasis rules may be prepared, and means such as interpolation calculation means may be prepared for adjusting the fundamental emphasis rule for each field.

A temperature of the liquid crystal panel influences a liquid crystal response speed. Generally, if the temperature is high, the response speed rises, whereas if the temperature is low, the response speed lowers. Therefore, if the temperature is high, a small emphasis process amount is sufficient, whereas if the temperature is low, the emphasis process amount is required to be made large. For example, if means is provided for detecting a temperature of the liquid crystal panel and adjusting the emphasis rule in accordance with the detected temperature, a good display quality with higher uniformity can be obtained.

A γ value of the liquid crystal display panel is a value indicating the relation between input gray-scale display data and a display luminance of the liquid crystal display panel. As described earlier, in the display device of the present invention, the relation between input gray-scale display data and display luminance is determined from the field conversion rule. Namely, as the γ value of the liquid crystal display panel is changed, it becomes necessary to change the field conversion rule, and it becomes correspondingly necessary to change the emphasis rule. It is therefore preferable to prepare a plurality of pairs of the field conversion rule and emphasis rule adjusted in accordance with the γ value of the liquid crystal display panel. If the γ value changes, the field conversion rule and emphasis rule matching the γ value are selectively used.

A length of one frame period indicates an update period of input display data. As the length of one frame period becomes short, a time sufficient for liquid crystal to respond cannot be maintained, so that a display of the liquid crystal panel cannot follow input display data and the image quality is degraded. In this case, a large emphasis process amount is effective for suppressing the image quality from being degraded. Conversely, as the length of one frame period becomes long, follow-up of the liquid crystal display panel is improved and image quality degray-scale is hard to occur. In this case, it is possible to reduce the emphasis process amount. Accordingly, for example, if means is provided for detecting a length of one frame period and adjusting the emphasis rule in accordance with the length of one frame period, a good display quality with higher uniformity can be obtained.

A ratio between lengths of field periods is, for example, a ratio of a length of the field A to a length of the field B. It is not necessarily required that a length of the field A period and a length of the field B period have a ratio of 1:1. For example, if the field period for a high gray-scale is shortened and the field period for a low gray-scale is elongated, the optical emission characteristics become nearer to the impulse type, so that the moving image display quality can be improved. Therefore, for example, by adjusting the ratio among field periods, the moving image display quality can be adjusted. In this case, as described earlier, for example, if means is provided for adjusting the emphasis process amount to be small for the field having a long field period and to be large for the field having a short field period, a good display quality with higher uniformity can be obtained.

A color of display data corresponds to each of the colors of D(n) and D(n−1). For example, a pixel of the liquid crystal display panel is constituted of three subsidiary pixels of red, green and blue, and the gray-scale data is different for each subsidiary pixel. Different gray-scale data of three subsidiary pixels means that the response times of three subsidiary pixels are not always uniform. Therefore, for example, if the response time of one subsidiary pixel is much longer or shorter than that of other two subsidiary pixels, a balance of luminance is lost during the response, so that noises called color shift rendering colors not anticipated, are generated. In order to avoid color shift noises, the response time characteristics of the red, green, blue subsidiary pixels are required to be as uniform as possible. Accordingly, if means is provided for adjusting the emphasis rule for each subsidiary pixel so as not to generate color shift noises to be caused by irregular response times of the subsidiary pixels, for example, in the color combination of D(n) and D(n−1), a good display quality with higher uniformity can be obtained.

In the above description, the order of the field A and field B may be reversed.

By configuring the display device in the manner described above, drive means such as shown in FIG. 2C combining the frame division drive and emphasis drive can be realized and a good image quality reducing moving image blurring can be obtained.

By applying the frame division drive to a hold-type display device, the optical emission characteristics of an impulse type display device can be realized and a good display quality with less moving image blurring can be obtained. By using the emphasis drive, it is possible to shorten the time required for an apparent luminance response and obtain a good display quality with less moving image blurring. By controlling the emphasis drive for each frame-divided field, a good display quality with suppressed pseudo contour lines and color shift can be obtained. Since the frame division drive and emphasis drive share one chip frame memory control circuit and one chip frame memory, the circuit scale and the number of components can be reduced more than that the field division drive and emphasis drive are performed independently.

Second Embodiment

In the following, the second embodiment of the present invention will be described with reference to FIGS. 7 and 8.

Figure 7:
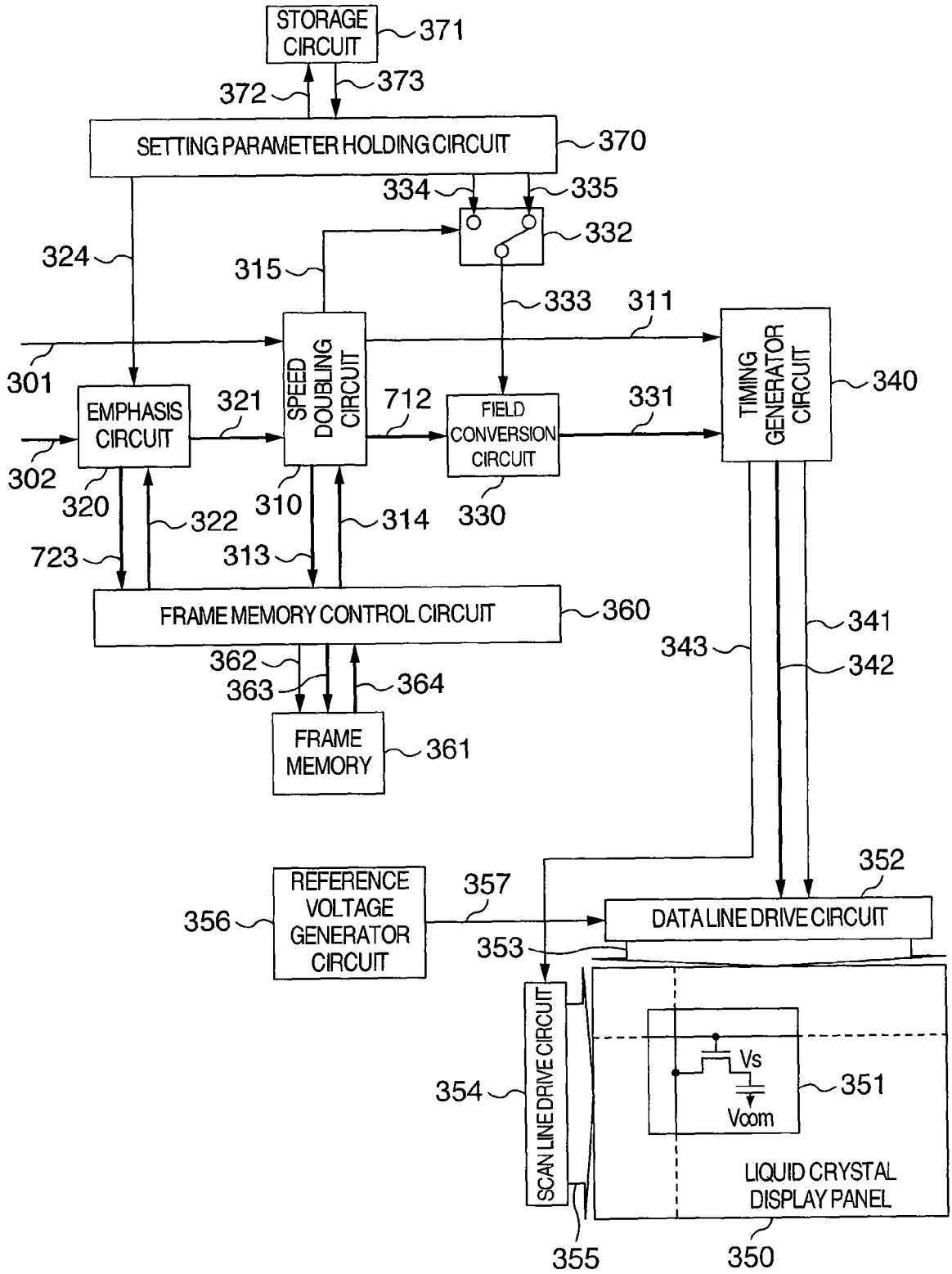
FIG. 7 is a diagram showing an example of the structure of the display device according to the second embodiment of the present invention.

FIG. 7 is a diagram showing an example of the structure of a display device according to the second embodiment of the present invention. FIG. 8 is a diagram illustrating an example of the operation of the display device according to the second embodiment of the present invention, and showing a timing chart of the display device shown in FIG. 7. In the second embodiment, the structures having identical reference numerals to those of the first embodiment are the same as those of the first embodiment. In the following, the second embodiment will be described mainly on different points from the first embodiment.

The emphasis circuit 320 receives input display data 302, and instructs the frame memory control circuit 360 to read input display data one frame before the input display data 302 from the frame memory 361 synchronously with an input of the input display data 302. The emphasis circuit 320 generates emphasis data 321 by subjecting the input display data 302 to data conversion for the emphasis drive, on the basis of the relation between the input display data 302 and the input display data 322 one frame before and in accordance with a predetermined emphasis rule. The emphasis rule is input as an emphasis parameter 324 from the setting parameter holding circuit 370 to the emphasis circuit 320. The emphasis circuit 320 writes the received input display data 302 in the frame memory 361. Reference numeral 723 represents data to be written in the frame memory 361.

The speed doubling circuit 310 instructs the frame memory control circuit 360 to sequentially store the input emphasis data 321 in the frame memory 361. The speed doubling circuit 310 instructs also the frame memory control circuit 360 to read the stored emphasis data of one frame period, in one frame period divided by two. The frame frequency can be doubled by reading the emphasis data twice in one frame period. The emphasis data read first time is used as the speed-doubled emphasis data for the field A, and the emphasis data read second time is used as the speed-doubled emphasis data for the field B. The speed doubling circuit 310 generates a field judgement signal 315 and a speed-doubled control signal group 311. The field judgement signal 315 is synchronous with the speed-doubled emphasis data 712, and is used for judging whether the speed-doubled emphasis data 712 is the speed-doubled emphasis data for the field A or for the field B.

Next, the operation of each circuit portion of the display device of the second embodiment will be described with reference to FIG. 8.

Figure 8:
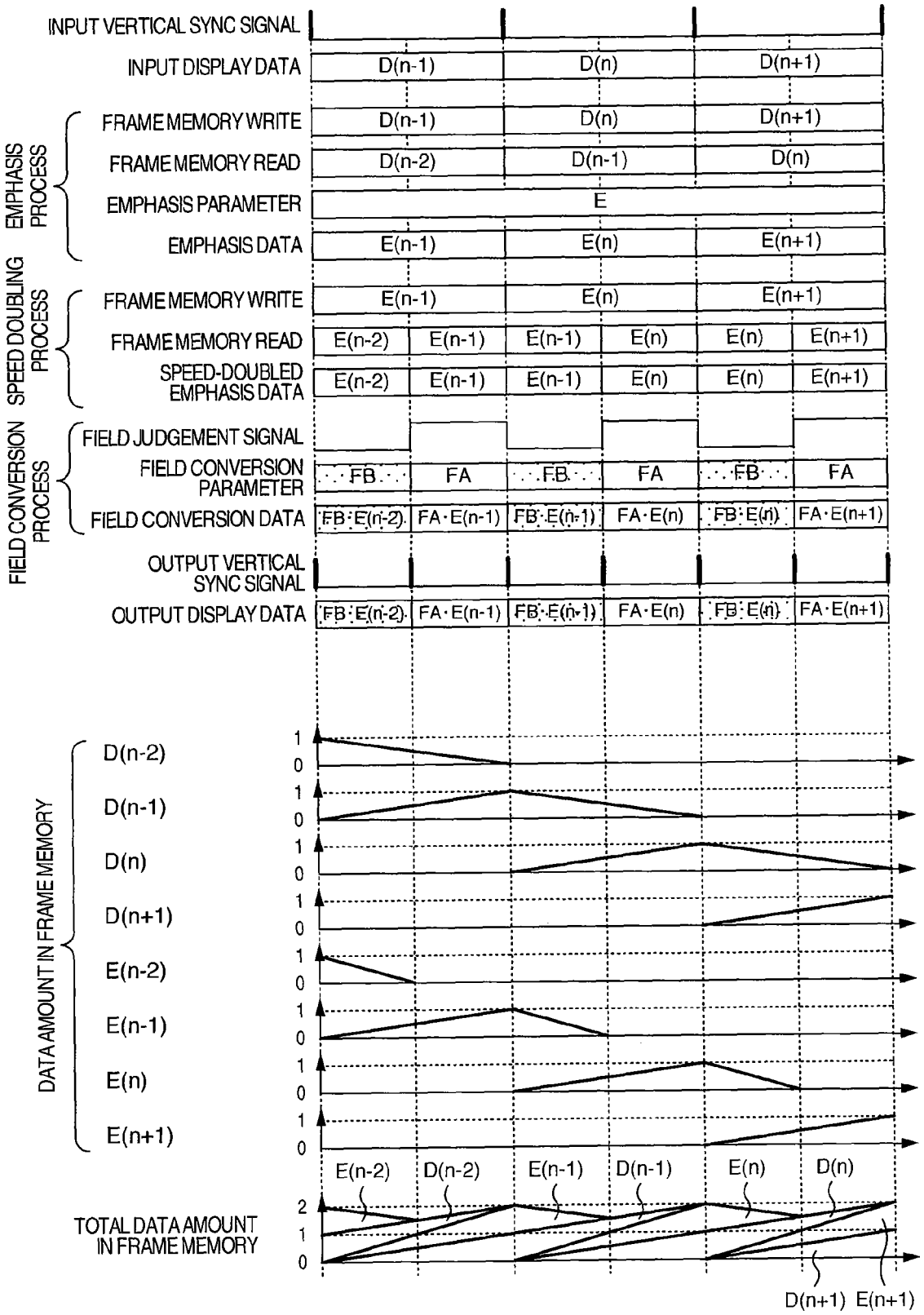
FIG. 8 is a diagram showing an example of the operation of the display device according to the second embodiment of the present invention.

FIG. 8 shows an example of a timing chart illustrating the operation of the display device shown in FIG. 7. The abscissa represents a time. An upper area in FIG. 8 shows an example of a signal waveform group of each circuit portion of the display device.

The emphasis circuit 320 executes the emphasis process for the input display data 302. The emphasis circuit 320 received the input display data 302 and reads input display data one frame before the input display data from the frame memory, in one frame period, synchronously with the input display data 302. For example, when input display data of the n-th frame is input, data of the (n−1)-th frame is read from the frame memory synchronously with the input display data. The emphasis data 321 is generated by using the input display data 302, data 322 read from the frame memory 361 and emphasis parameter 324.

In FIG. 8, a symbol E represents the emphasis parameter, and a symbol E(n) represents the emphasis data of the n-th frame. Similarly, for example, E(n−1) represents the emphasis data in the (n−1)-th frame. For example, if the input display data 302 is input in the unit of one frame period in the order of, . . . D(n−1), D(n), (D+1), . . . , then the input display data one frame after is read from the frame memory 361 in the order of, . . . D(n−2), D(n−1), D(n), . . . . At this time, the emphasis parameter 324 is input to the emphasis circuit 320. In accordance with these signals, the emphasis process is executed to generate and output the emphasis data 321 in the order of, . . . E(n−1), E(n), E(n+1), . . . .

Next, the speed doubling circuit 310 executes the speed doubling process. The speed doubling circuit 310 instructs the frame memory controller 360 to sequentially write the emphasis data 321 in the frame memory 361. The order of data to be written in the frame memory 361 in one frame period is, . . . E(n−1), E(n), E(n+1), . . . . . The speed doubling circuit 310 instructs also the frame memory control circuit 360 to read data written in the frame memory 361. The order of data to be read from the frame memory 361, in the unit of one field period obtained by halving one frame period, is, . . . E(n−2), E(n−1), E(n−1), E(n), E(n), E(n+1), . . . The speed doubling circuit 310 outputs the data read from the frame memory 361 as speed-doubled emphasis data 712. The speed doubling circuit 310 generates also the field judgement signal 315. In FIG. 8, a symbol FA represents a field conversion parameter A for the field A, and a symbol FB represents a field conversion parameter B for the field B. In FIG. 8, a symbol FA-E(n) represents data obtained by subjecting the speed-doubled emphasis data of the n-th frame to field conversion for the field A. Similarly, for example, a symbol FA·E(n−1) represents data obtained by subjecting the speed-doubled emphasis data of the (n−1)-th frame to field conversion for the field A. In FIG. 8, a symbol FB·E(n) represents data obtained by subjecting the speed-doubled emphasis data of the n-th frame to field conversion for the field B. Similarly, for example, a symbol FB·E(n−1) represents data obtained by subjecting the speed-doubled emphasis data of the (n−1)-th frame to field conversion for the field B. For example, if the speed-doubled data 712 is input in the order of, . . . E(n−2), E(n−1), E(n−1), E(n), E(n), E(n+1), . . . , then the field conversion parameter selector 332 selects the field conversion parameters in the order of, . . . FB, FA, FB, FA, FB, FA, . . . in accordance with the field judgement signal 315, and inputs the field conversion parameters to the field conversion circuit 330. The field conversion process is executed by using these signals to generate and output the field conversion data 331 in the order of, . . . FB·E(n−2), FA·E(n−1), FB·E(n−1), FA·E(n), FB·E(n), FA·E(n+1), . . . .

A lower area in FIG. 8 shows a graph indicating a change in a data amount in the frame memory 361. The abscissa represents a frame (i.e., time) and the ordinate represents a data amount. A data amount of one frame is indicated by 1.

The frame memory 361 stores and holds data of each frame during a period necessary for processing at each circuit. Data of an unnecessary frame is sequentially discarded or new frame data is overwritten. For example, in the case of data D(n−1) of the (n−1)-th frame, as the data input of the (n−1)-th frame starts, the data amount in the frame memory increases gradually. When the data input of the (n−1)-th frame is completed, data of one frame is stored in the frame memory 361. During the period while data of the n-th frame is input, the data of the (n−1)-th frame is read for the emphasis process. The data of the (n−1)-th frame once read becomes unnecessary. Therefore, the data of the (n−1)-th frame once read is sequentially discarded or new data is overwritten. When the first half of the n-th frame is completed, the data amount of the (n−1)-th frame in the frame memory 361 is 0. As described above, data of each frame is subjected to two stages: write and discard and is stored in the frame memory 361 during 2 frame periods in total. A series of operations described above is always executed for each frame.

Similarly, in order to generate doubled-speed emphasis data, the emphasis data is also stored in the frame memory 361. For example, in the case of the emphasis data E(n−1) of the (n−1)-th frame, as the data input of the (n−1)-th frame starts, the data amount in the frame memory increases gradually. When the data input of the (n−1)-th frame is completed, data of one frame is stored in the frame memory 361. During the second half period of the (n−1)-th frame, an operation of writing emphasis data of the (n−1)-th frame is performed and also an operation of reading the emphasis data of the (n−1)-the frame for the speed doubling process is performed.

Next, during the period while data of the n-th frame is input, the emphasis data of the (n−1)-th frame is read at double speed because the first half of the frame period is used for the emphasis process. The emphasis data of the (n−1)-th frame once read becomes unnecessary. Therefore, the data of the (n−1)-th frame once read is sequentially discarded or new data is overwritten. When the first half of the n-th frame is completed, the data amount of the (n−1)-th frame in the frame memory 361 is 0. As described above, the emphasis data of each frame is subjected to two stages: write and discard and is stored in the frame memory 361 during 1.5 frame periods in total. A series of operations described above is always executed for each frame. A change in the data amount in the frame memory 361 in each frame period has been described above.

The lowermost area of FIG. 8 shows a graph indicating a change in a total data amount of each frame. As shown, although there is a variation in the data amount, the total data amount will not exceed two frames. Namely, the display device of the present invention can be realized if the frame memory 361 has a capacity of two frames.

Figure 9:
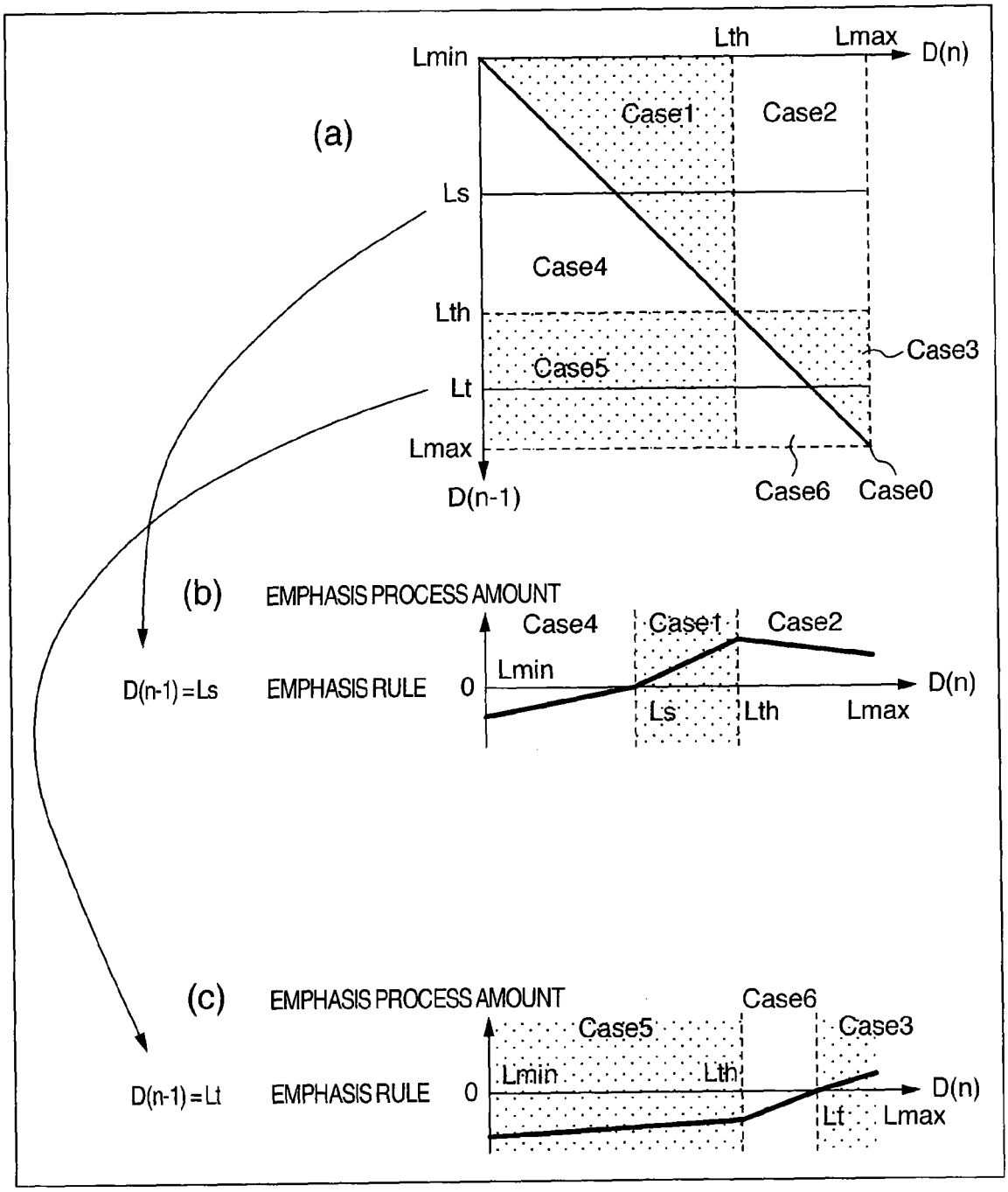
FIG. 9 is a diagram showing examples of emphasis rules used for the emphasis drive of the display device according to the second embodiment of the present invention.

A portion (a) in FIG. 9 is a diagram showing an example of the emphasis rule to be used when the emphasis circuit 320 of the display device of the second embodiment executes the emphasis process. The abscissa represents input display data D(n) of the n-th frame, and the ordinate represents input display data D(n−1) of the (n−1)-th frame. In the second embodiment, the field conversion source data corresponds to the speed-doubled emphasis data 712, and the field conversion data after the field conversion corresponds to the field conversion data 331. Similar to the emphasis rule of the first embodiment shown in the portion (a) in FIG. 6, the emphasis rule of the second embodiment shown in the portion (a) is tightly related to the field conversion rule shown in FIG. 7 and can be classified into seven Cases: Case 0 to Case 6. In the first embodiment, two emphasis rules are used: an emphasis rule for the field A and an emphasis rule for the field B. The second embodiment uses one emphasis rule. The first and second embodiments use different emphasis rules.

A summary of the emphasis rule will be described with reference to FIG. 9.

Since Case 0 does not require emphasis, the emphasis process amount is 0 (Emphasis process amount=0).

Case 1, Case 2 and Case 3 require the rise emphasis process (emphasis process amount>0). Since Case 1, Case 2 and Case 3 have different display methods for the luminance of D(n) and D(n−1), it is preferable to use different emphasis rules.

Case 4, Case 5 and Case 6 require the rise emphasis process (emphasis process amount>0). Since Case 4, Case 5 and Case 6 have different display methods for the luminance of D(n) and D(n−1), it is preferable to use different emphasis rules.

The emphasis rule will be described more in detail by using specific examples of portions (b) and (c) in FIG. 9.

The portions (b) and (c) are graphs showing examples of the emphasis rule of the second embodiment. In the portions (b) and (c), the abscissa represents a value of D(n) and the ordinate represents the emphasis process amount. The emphasis process amount indicates a value of emphasis data to be added to D(n) for the emphasis process, and can take positive and negative values.

The portion (b) in FIG. 9 is a diagram showing an example of how the emphasis amount is determined in accordance with the value of D(n) if D(n−1) has a gray-scale Ls (Ls<Lth). As described earlier, the emphasis rule is classified into seven Cases. Since D(n−1)=Ls in the portion (b), the emphasis rule is Case 4 for D(n)<Ls, Case 0 for D(n) =Ls, Case 1 for Ls<D(n)<Lth, and Case 2 for Lth<D(n).

The portion (c) in FIG. 9 is a diagram showing an example of how the emphasis amount is determined in accordance with the value of D(n) if D(n−1) has a gray-scale Lt (Lt<Lth). As described earlier, the emphasis rule is classified into seven Cases. Since D(n−1)=Lt in the portion (c), the emphasis rule is Case 5 for D(n)<Lth, Case 6 for Lth <D(n)<Lt, Case 0 for D(n)=Lt, and Case 3 for Lt<D(n).

In the portions (b) and (c), although D(n−1) is Ls or Lt, D(n−1) may take a different value in order to set the emphasis rule. An example of the portions (b) and (c) are only illustrative. The emphasis rule may be set by using the emphasis process amount graphs having complicated curves.

The display device constructed as above can realize drive means shown in FIG. 2A combining the frame division drive and emphasis drive, so that a good image quality can be obtained, reducing moving image blurring.

The present invention is applicable to a liquid crystal television.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A display device comprising:

a display panel including a plurality of pixels;

a first drive circuit for outputting a display signal corresponding to display data with a gray-scale to said pixels;

a second drive circuit for outputting a select signal to said pixels, said select signal selecting a pixel which receives said display signal;

a first conversion circuit for receiving said display data in a frame period, converting said display data in an n-th frame period, where n is an integer of two or more, in accordance with a value of a gray-scale of display data in an n−1 th frame period and a value of a gray-scale of said display data in the n-th frame period, and outputting m display data in m periods in said n-th frame period, where m is an integer of two or more; and a second conversion circuit for converting each of said m display data in such a manner that said pixels provide a luminance corresponding to the gray-scale of said display data input during said n-th frame period by using said m display data, wherein:

said first drive circuit outputs said display signal corresponding to each gray-scale value of said m display data supplied from said second conversion circuit in each of said m periods in said n-th frame period, to said pixels;

at least one of said m display data has either one of an upper limit gray-scale value or a lower limit gray-scale value of a dynamic range of said display data;

at least another of said m display data has a gray-scale value which changes responsive to a change of the gray-scale value of said display data in said n-th frame period from said display data in said n−1 th frame period, the gray-scale value of the at least another of said m display data being determined in accordance with a gray-scale value change between said display data in said n−1 th frame period and said display data in said n-th frame period;

said first conversion circuit increases a gray-scale value of at least one display data other than display data having the upper limit gray-scale value of the dynamic range among said m display data in said n-th frame period, if a gray-scale value of said display data in said n-th frame period is larger than a gray-scale value of said display data in said n−1 th frame period; and said first conversion circuit decreases a gray-scale value of at least one display data other than display data having the lower limit gray-scale value of the dynamic range among said m display data in said n-th frame period, if a gray-scale value of said display data in said n-th frame period is smaller than a gray-scale value of said display data in said n−1 th frame period.

2. The display device according to claim 1, wherein said first conversion circuit converts each of said m display data in said n-th frame period in accordance with a rule defined for each of said m display data.

3. The display device according to claim 1, wherein:

said second conversion circuit converts at least one of said m display data into display data having a minimum gray-scale value, if a gray-scale value of said m display data is smaller than a predetermined value between maximum and minimum gray-scale values of said display data or smaller than a predetermined range;

said second conversion circuit converts at least one of said m display data into display data having a maximum gray-scale value, if the gray-scale value of said m display data is larger than said predetermined value or said predetermined range; and said first conversion circuit converts said display data in said n-th frame period in accordance with whether a gray-scale value of said display data in said n−1 th frame period is larger/smaller than said predetermined value or said predetermined range, and/or, in accordance with whether the gray-scale value of said display data in said n-th frame period is larger/smaller than said predetermined value or said predetermined range.

4. The display device according to claim 1, wherein:

said first conversion circuit increases a gray-scale value of at least one display data other than display data having a maximum gray-scale value among said m display data in said n-th frame period, if a gray-scale value of said display data in said n-th frame period is larger than a gray-scale value of said display data in said n−1 th frame period; and said first conversion circuit decreases a gray-scale value of at least one display data other than display data having a minimum gray-scale value among said m display data in said n-th frame period, if a gray-scale value of said display data in said n-th frame period is smaller than a gray-scale value of said display data in said n−1 th frame period.

5. The display device according to claim 1, wherein an amount of display data to be outputted during the n-th frame period is two.

6. A display device comprising:

a display panel disposing a plurality of pixels;

a first drive circuit for outputting a display signal corresponding to display data with a gray-scale to said pixels;

a second drive circuit for outputting a select signal to said pixels, said select signal selecting a pixel which receives said display signal;

a first conversion circuit for receiving said display data in a frame period, converting said display data in an n-th frame period, where n is an integer of two or more, in accordance with a gray-scale value of display data in an n−1 th frame period and a gray-scale value of display data in the n-th frame period, and outputting first display data in a first period in said n-th frame period and second display data in a second period in said n-th frame period; and a second conversion circuit for converting each of said first display data and said second display data in such a manner that said pixels provide a luminance corresponding to the gray-scale value of said display data input during said n-th frame period by using said first display data and said second display data, wherein:

said first drive circuit outputs display signal corresponding to a gray-scale value of said first display data in said first period and display signal corresponding to a gray-scale value of said second display data in said second period, respectively to said pixels;

at least one of said first display data and said second display data has either one of an upper limit gray-scale value or a lower limit gray-scale value of a dynamic range of said display data;

at least another of said first display data and said second display data has a gray-scale value which changes responsive to a change of the gray-scale value of said display data in said n-th frame period from that in said n−1 th frame period, the gray-scale value of the at least another of said first display data and said second display data being determined in accordance with a gray-scale value change between said display data in said n−1 th frame period and said display data in said n-th frame period;

said first conversion circuit emphasizes display data having a larger gray-scale value among said first display data and said second display data, if a gray-scale value of said display data in said n-th frame period is larger than a gray-scale value of said display data in said n−1 th frame period and if both said first display data and said second display data in said n-th frame period do not have a maximum gray-scale value;

if a gray-scale value of said display data in said n-th frame period is larger than a gray-scale value of said display data in said n−1 th frame period and if one of said first display data and said second display data in said n-th frame period has a gray-scale maximum value, said first conversion circuit emphasizes the other of said first display data and said second display data;

said first conversion circuit emphasizes display data having a smaller gray-scale value among said first display data and said second display data, if a gray-scale value of said display data in said n-th frame period is smaller than a gray-scale value of said display data in said n−1 th frame period and if both said first display data and said second display data in said n-th frame period do not have a minimum gray-scale value; and if a gray-scale value of said display data in said n-th frame period is smaller than a gray-scale value of said display data in said n−1 th frame period and if one of said first display data and said second display data in said n-th frame period has a minimum gray-scale value, said first conversion circuit emphasizes the other of said first display data and said second display data.

7. The display device according to claim 6, wherein said first conversion circuit converts each of said display data in said first period in said n-th frame period and said display data in said second period, in accordance with a rule defined for each of said display data in said first period and said display data in said second period.

8. The display device according to claim 6, wherein:

said second conversion circuit converts one of said first display data and said second display data into display data having a minimum gray-scale value, if a gray-scale value of said display data in the n-th frame period is smaller than a predetermined value between maximum and minimum gray-scale values of said display data or smaller than a predetermined range;

said second conversion circuit converts the other of said first display data and said second display data into display data having a maximum gray-scale value, if a gray-scale value of said display data in the n-th frame period is larger than said predetermined value or said predetermined range; and said first conversion circuit emphasizes said display data in said n-th frame period in accordance with whether a gray-scale value of said display data in said n−1 th frame period is larger/smaller than said predetermined value or said predetermined range, and/or, in accordance with whether a gray-scale value of said display data in said n-th frame period is larger/smaller than said predetermined value or said predetermined range.

9. The display device according to claim 6, wherein:

said first conversion circuit increases one of said first display data and said second display data in said n-th frame period, if a gray-scale value of said display data in said n-th frame period is larger than a gray-scale value of said display data in said n−1 th frame period; and said first conversion circuit decreases a gray-scale value of the other of said first display data and said second display data in said n-th frame period, if a gray-scale value of said display data in said n-th frame period is smaller than a gray-scale value of said display data in said n−1 th frame period.

10. The display device according to claim 6, comprising:

one chip storage circuit; and one chip control circuit for controlling read/write of said display data relative to said storage circuit, wherein:

said control circuit writes said display data in said n−1 th frame period in said storage circuit, and reads said display data in said n−1 th frame period after one frame period in said storage circuit; and said control circuit writes said display data of one frame in said storage circuit, and reads said display data of one frame twice in one frame period from said storage circuit.

11. The display device according to claim 6, wherein said first conversion circuits comprises:

a speed doubling circuit for receiving said display data in said frame period and outputting said display data in each of said first period and said second period in said n-th frame period; and an emphasis circuit for emphasizing each of said display data in said first period and said display data in said second period respectively supplied from said speed doubling circuit, in accordance with a rule defined for each of said display data in said first period and said display data in said second period and in accordance with a value of said display data in said n−1 th frame period and a value of said display data in said n-th period.

12. The display device according to claim 6, wherein said first conversion circuit comprises:

an emphasis circuit for emphasizing said display data in said n-th frame period in accordance with a gray-scale value of said display data in said n−1 th frame period and a gray-scale value of said display data in said n-th frame period; and a speed doubling circuit for receiving said display data in said n-th frame period from said emphasis circuit and outputting said display data in each of said first period and said second period in said n-the frame period.

13. The display device according to claim 6, wherein said first conversion circuit converts each of said display data in said first period in said n-th frame period and said display data in said second period in said n-th frame period, in accordance with a rule defined for each of said display data in said first period and said display data in said second period in accordance with a-gray-scale value change from said display data in said n−1 th frame period to said display data in said n-th frame period.

* * * * *